US009478159B2

(12) United States Patent
Choi

(10) Patent No.: US 9,478,159 B2
(45) Date of Patent: Oct. 25, 2016

(54) DISPLAY DEVICE HAVING SHORT AND LONG LIGHT EMITTING PERIODS. APPARATUS FOR SIGNAL CONTROL DEVICE OF THE SAME, AND SIGNAL CONTROL METHOD

(71) Applicant: Seung-Rock Choi, Yongin (KR)

(72) Inventor: Seung-Rock Choi, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 256 days.

(21) Appl. No.: 13/783,777

(22) Filed: Mar. 4, 2013

(65) Prior Publication Data

US 2014/0139565 A1 May 22, 2014

(30) Foreign Application Priority Data

Nov. 20, 2012 (KR) ..... 10-2012-0131875

(51) Int. Cl.
*G09G 3/20* (2006.01)
*G09G 3/32* (2016.01)

(52) U.S. Cl.
CPC ..... *G09G 3/2018* (2013.01); *G09G 3/3233* (2013.01); *G09G 3/3291* (2013.01); *G09G 2310/0297* (2013.01); *G09G 2320/0276* (2013.01); *G09G 2320/045* (2013.01)

(58) Field of Classification Search
CPC . G09G 3/3208; G09G 3/3225; G09G 3/3233
USPC ..... 345/76–100, 102, 211–212, 690–691
See application file for complete search history.

(56) References Cited

U.S. PATENT DOCUMENTS

| | | | | |
|---|---|---|---|---|
| 2006/0146005 | A1* | 7/2006 | Baba et al. | 345/102 |
| 2006/0170625 | A1* | 8/2006 | Kim | G09G 3/3225 345/76 |
| 2007/0035498 | A1* | 2/2007 | Jeon | G09G 3/2025 345/92 |
| 2009/0033602 | A1* | 2/2009 | Alexander et al. | 345/77 |
| 2010/0053137 | A1* | 3/2010 | Park et al. | 345/211 |
| 2011/0025671 | A1* | 2/2011 | Lee | 345/211 |
| 2011/0292015 | A1* | 12/2011 | Komiya | 345/211 |
| 2012/0056879 | A1* | 3/2012 | Song et al. | 345/419 |
| 2012/0098826 | A1* | 4/2012 | Lee et al. | 345/419 |
| 2012/0249615 | A1* | 10/2012 | Lee | 345/691 |
| 2013/0121419 | A1* | 5/2013 | Le Dinh et al. | 375/240.16 |

FOREIGN PATENT DOCUMENTS

| | | |
|---|---|---|
| KR | 10-2009-0088316 A | 8/2009 |
| KR | 10-2011-0013693 A | 2/2011 |
| KR | 10-2012-0028426 A | 3/2012 |

* cited by examiner

*Primary Examiner* — Jonathan Boyd
*Assistant Examiner* — James Nokham
(74) *Attorney, Agent, or Firm* — Lee & Morse, P.C.

(57) ABSTRACT

A display device includes a plurality of pixels, a scan driver sequentially applying a scan signal to a plurality of scan lines, a data driver applying a data signal corresponding to the scan signal to a plurality of data lines, and a signal controller calculating an image parameter from an image signal, and generating and transmitting one of a driving control signal for short period light emitting and a driving control signal for long period light emitting to the scan driver and the data driver by using the image parameter. The driving control signal for short period light emitting is a signal controlling a light emitting period in which a plurality of pixels emit light during one frame with a first period. The driving control signal for long period light emitting is a signal controlling the light emitting period with a second period that is longer than the first period.

38 Claims, 12 Drawing Sheets

DISPLAY DEVICE HAVING SHORT AND LONG LIGHT EMITTING PERIODS. APPARATUS FOR SIGNAL CONTROL DEVICE OF THE SAME, AND SIGNAL CONTROL METHOD

CROSS-REFERENCE TO RELATED APPLICATION

This application claims priority to and the benefit of Korean Patent Application No. 10-2012-0131875 filed in the Korean Intellectual Property Office on Nov. 20, 2012, the entire contents of which are incorporated herein by reference.

BACKGROUND

1. Field

Embodiments relate to a display device, a signal control device of a display device, and a signal control method.

2. Description of the Related Art

An organic light emitting diode (OLED) display uses an organic light emitting diode (OLED) having luminance that is controlled by a current or a voltage. The organic light emitting diode (OLED) includes an anode and a cathode forming an electric field, and an organic light emitting material emitting light by the electric field.

In general, the organic light emitting diode (OLED) display is classified into a passive matrix type of OLED (PMOLED) and an active matrix type of OLED (AMOLED) according to a driving method of the organic light emitting diode (OLED).

Among them, in views of resolution, contrast, and operation speed, the AMOLED that is selectively turned on for every unit pixel is mainly used.

The above information disclosed in this Background section is only for enhancement of understanding of the background of the invention and therefore it may contain information that does not form the prior art that is already known in this country to a person of ordinary skill in the art.

SUMMARY

Embodiments are directed to a display device, including a plurality of pixels, a scan driver sequentially applying a scan signal to a plurality of scan lines coupled to the plurality of pixels, a data driver applying a data signal corresponding to the scan signal to a plurality of data lines coupled to the plurality of pixels, and a signal controller calculating an image parameter from an image signal, and generating and transmitting one of a driving control signal for short period light emitting and a driving control signal for long period light emitting to the scan driver and the data driver by using the image parameter. The driving control signal for short period light emitting is a signal controlling a light emitting period in which a plurality of pixels emit light during one frame with a first period, and the driving control signal for long period light emitting is a signal controlling the light emitting period with a second period that is longer than the first period.

A second reset period, in which a gate voltage of a driving transistor is reset during a second frame according to the driving control signal for long period light emitting, may be shorter than a first reset period, in which the gate voltage of the driving transistor is reset during a first frame according to the driving control signal for short period light emitting, by a period Δd, and the second period may be longer than the first period by the period Δd.

A time of a second compensation period compensating a threshold voltage of the driving transistor during a second frame according to the driving control signal for long period light emitting may be earlier than a time of a first compensation period compensating the threshold voltage of the driving transistor during the first frame according to the driving control signal for short period light emitting by the period Δd.

A time of a second scan period in which the data signal is written to a plurality of pixels during the second frame according to the driving control signal for long period light emitting may be earlier than a time of a first scan period in which the data signal is written to a plurality of pixels during the first frame according to the driving control signal for short period light emitting by the period Δd.

The signal controller may sum grayscale data of the image signal by a frame unit to calculate a grayscale data sum, and a current contribution rate may be multiplied by the grayscale data sum to calculate the image parameter.

The grayscale data of the image signal may include grayscale data of a red pixel, grayscale data of a green pixel, and grayscale data of a blue pixel, and the signal controller may sum the grayscale data of the red pixel, the grayscale data of the green pixel, and the grayscale data of the blue pixel by a frame unit to calculate a grayscale data sum of the red pixel, a grayscale data sum of the green pixel, and a grayscale data sum of the blue pixel.

The signal controller may sum a first value for which a current contribution rate of the red pixel is multiplied by the grayscale data sum of the red pixel, a second value for which a current contribution rate of the green pixel is multiplied by the grayscale data sum of the green pixel, and a third value for which a current contribution rate of the blue pixel is multiplied by the grayscale data sum of the blue pixel to calculate the image parameter.

The signal controller may compare the image parameter with a first threshold value, and if the image parameter is larger than the first threshold value, the signal controller may generate the driving control signal for long period light emitting, while if the image parameter is equal to or less than the first threshold value, the signal controller may generate the driving control signal for short period light emitting.

The signal controller may store a control parameter by adding 1 if the image parameter is larger than the first threshold value, and, if the image parameter is equal to or less than the first threshold value, the control parameter may be stored as 0.

After the signal controller stores the control parameter by adding 1, when the stored control parameter is larger than 1, the signal controller may generate the driving control signal for long period light emitting, and when the stored control parameter is 1, the signal controller may generate the driving control signal for short period light emitting.

The signal controller may generate the driving control signal for short period light emitting when the control parameter is 0.

The signal controller may calculate a parameter deviation of a first image parameter calculated in a current frame and a second image parameter calculated in a previous frame.

The signal controller may compares the parameter deviation with a second threshold value, and if the parameter deviation is larger than the second threshold value, the signal controller may generate the driving control signal for short period light emitting, while if the parameter deviation is equal to or less than the second threshold value, the signal controller may generate the driving control signal for long period light emitting.

The signal controller may calculate the image parameter when a 3D index included in the image signal instructs a 3D image.

When the 3D index instructs a 2D image, the signal controller may generate the driving control signal for long period light emitting.

The plurality of pixels may simultaneously emit the light during the first period and the second period.

Embodiments are also directed to a signal control device, including an image signal adder adding grayscale data by an image signal by a frame unit to calculate a grayscale data sum, an image parameter calculator multiplying a current contribution rate by the grayscale data sum to calculate an image parameter, an image parameter comparator comparing the image parameter with a threshold value, and a driving control signal generator generating one of a driving control signal for short period light emitting and a driving control signal for long period light emitting according to a comparison result of the image parameter and the threshold value. The driving control signal for short period light emitting is a signal controlling a light emitting period in which a plurality of pixels emit light during one frame with a first period, and the driving control signal for long period light emitting is a signal controlling the light emitting period with a second period that is longer than the first period.

The grayscale data of the image signal may include grayscale data of a red pixel, grayscale data of a green pixel, and grayscale data of a blue pixel, and the image signal adder may sum the grayscale data of the red pixel, the grayscale data of the green pixel, and the grayscale data of the blue pixel by a frame unit to calculate a grayscale data sum of the red pixel, a grayscale data sum of the green pixel, and a grayscale data sum of the blue pixel.

The image parameter calculator may sum a first value for which a current contribution rate of the red pixel is multiplied by the grayscale data sum of the red pixel, a second value for which a current contribution rate of the green pixel is multiplied by the grayscale data sum of the green pixel, and a third value for which a current contribution rate of the blue pixel is multiplied by the grayscale data sum of the blue pixel to calculate the image parameter.

The image parameter comparator may compare the image parameter with the first threshold value, and if the image parameter is larger than the first threshold value, a first signal generating the driving control signal for long period light emitting may be transmitted to the driving control signal generator, while if the image parameter is equal to or less than the first threshold value, a second signal generating the driving control signal for short period light emitting may be transmitted to the driving control signal generator.

The image parameter comparator may store a control parameter by adding 1 if the image parameter is larger than the first threshold value, and if the image parameter is equal to or less than the first threshold value, the control parameter may be stored as 0.

After the image parameter comparator stores the control parameter by adding 1, the image parameter comparator may generate a first signal when the stored control parameter is larger than 1, and the image parameter comparator may generate a second signal when the stored control parameter is 1.

The image parameter comparator may generate the second signal when the control parameter is 0.

The image parameter calculator may calculate a parameter deviation of a first image parameter calculated in a current frame and a second image parameter calculated in a previous frame.

The image parameter comparator may compare the parameter deviation with a second threshold value, and if the parameter deviation is larger than the second threshold value, the image parameter comparator may transmit a second signal generating the driving control signal for short period light emitting to the driving control signal generator, while if the parameter deviation is equal to or less than the second threshold value, the image parameter comparator may transmit a first signal generating the driving control signal for long period light emitting to the driving control signal generator.

When a 3D index included in the image signal instructs a 3D image, the driving control signal generator may generate one of the driving control signal for short period light emitting and the driving control signal for long period light emitting according to a comparison result of the image parameter and the threshold value.

When the 3D index instructs a 2D image, the driving control signal generator may generate the driving control signal for long period light emitting.

Embodiments are also directed to a signal control method, including summing grayscale data of an image signal by a frame unit to calculate a grayscale data sum, multiplying a current contribution rate by the grayscale data sum to calculate an image parameter, comparing the image parameter with a threshold value, and generating one of a driving control signal for short period light emitting and a driving control signal for long period light emitting according to a comparison result of the image parameter and the threshold value. The driving control signal for short period light emitting is a signal controlling a light emitting period in which a plurality of pixels emit light during one frame with a first period, and the driving control signal for long period light emitting is a signal controlling the light emitting period with a second period that is longer than the first period.

The calculation of the grayscale data sum may include summing grayscale data of a red pixel, grayscale data of a green pixel, and grayscale data of a blue pixel by a frame unit to calculate a grayscale data sum of the red pixel, a grayscale data sum of the green pixel, and a grayscale data sum of the blue pixel.

The calculation of the image parameter may include summing a first value for which a current contribution rate of the red pixel is multiplied by the grayscale data sum of the red pixel, a second value for which a current contribution rate of the green pixel is multiplied by the grayscale data sum of the green pixel, and a third value for which a current contribution rate of the blue pixel is multiplied by the grayscale data sum of the blue pixel to calculate the image parameter.

The comparison of the image parameter with the threshold value may include comparing the image parameter with a first threshold value, generating a first signal generating the driving control signal for long period light emitting if the image parameter is larger than the first threshold value, and generating a second signal generating the driving control signal for short period light emitting if the image parameter is equal to or less than the first threshold value.

The comparison of the image parameter with the threshold value may further include storing a control parameter by adding 1 if the image parameter is larger than the first threshold value, and storing the control parameter as 0 if the image parameter is equal to or less than the first threshold value.

The comparison of the image parameter with the threshold value may further include generating the first signal when the stored control parameter is larger than 1, and generating the second signal when the stored control parameter is 1.

The comparison of the image parameter with the threshold value may further include generating the second signal when the stored control parameter is 1.

The calculation of the image parameter may include calculating a parameter deviation of a first image parameter calculated in a current frame and a second image parameter calculated in a previous frame.

The comparison of the image parameter with the threshold value may include comparing the parameter deviation with a second threshold value, generating a second signal generating the driving control signal for short period light emitting if the image parameter is larger than the second threshold value, and generating a first signal generating the driving control signal for long period light emitting if the parameter deviation is equal to or less than the second threshold value.

The generation of one of the driving control signal for short period light emitting and the driving control signal for long period light emitting may include generating one of the driving control signal for short period light emitting and the driving control signal for long period light emitting according to a comparison result of the image parameter and the threshold value when a 3D index included in the image signal instructs a 3D image.

The generation of one of the driving control signal for short period light emitting and the driving control signal for long period light emitting may include generating the driving control signal for long period light emitting when the 3D index instructs a 2D image.

BRIEF DESCRIPTION OF THE DRAWINGS

Features will become apparent to those of skill in the art by describing in detail example embodiments with reference to the attached drawings in which.

DETAILED DESCRIPTION

Figure 1:
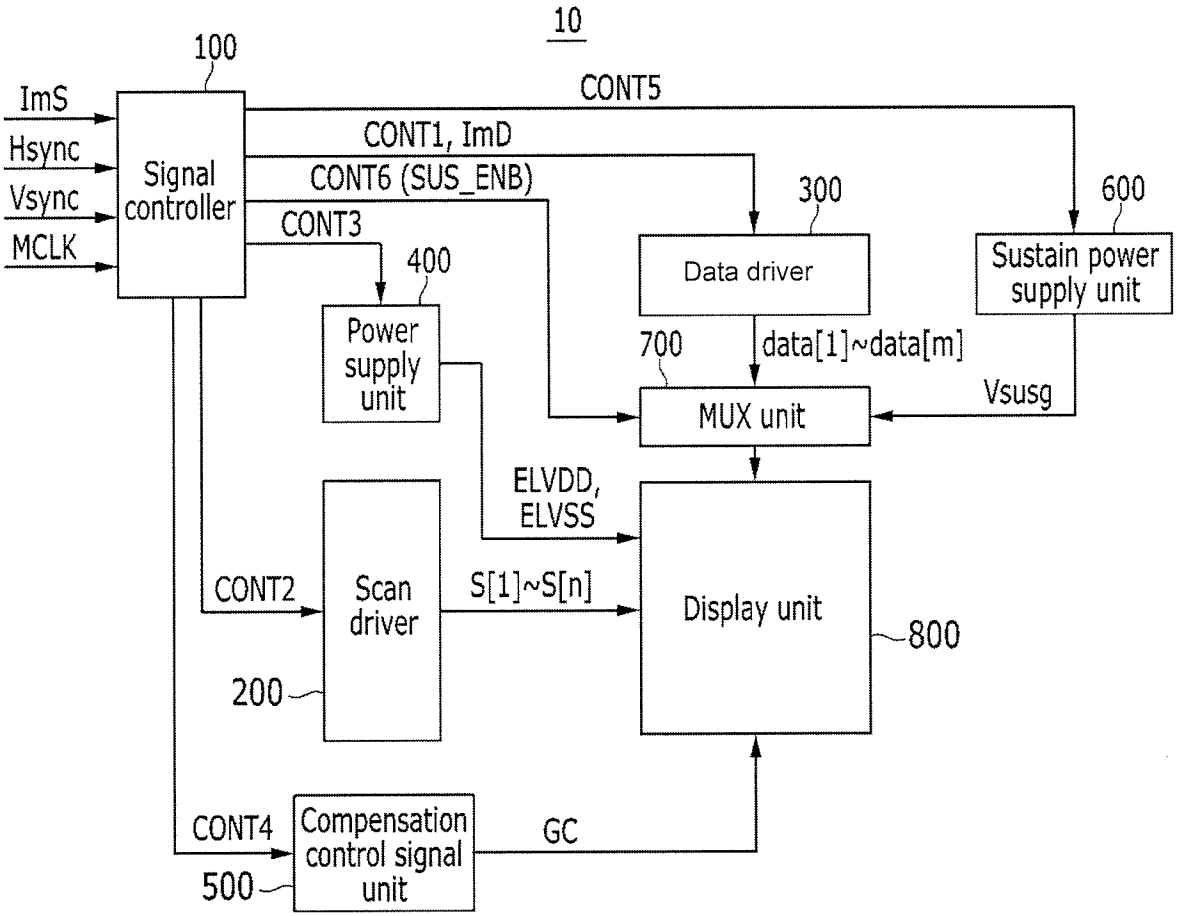
FIG. 1 is a block diagram of a display device according to an example embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. Like reference numerals refer to like elements throughout.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an example embodiment.

In the example embodiment shown in FIG. 1, a display device 10 includes a signal controller 100, a scan driver 200, a data driver 300, a power supply unit 400, a compensation control signal unit 500, a sustain power supply unit 600, a MUX unit 700, and a display unit 800.

The signal controller 100 receives an image signal Ims and a synchronization signal input from an external device. The input image signal ImS includes luminance information on a plurality of pixels. The luminance has a predetermined number of grays, for example, $1024=2^{10}$, $256=2^{8}$, or $64=2^{6}$. The synchronization signal includes a horizontal synchronization signal Hsync, a vertical synchronization signal Vsync, and a main clock signal MCLK.

The signal controller 100 generates first to sixth driving control signals CONT1, CONT2, CONT3, CONT4, CONT5, and CONT6, and an image data signal ImD according to the image signal ImS, the horizontal synchronization signal Hsync, the vertical synchronization signal Vsync, and the main clock signal MCLK. The first to sixth driving control signals CONT1 to CONT6 include first to sixth driving control signals CONT1' to CONT6' for short period light emitting and first to sixth driving control signals CONT1" to CONT6" for long period light emitting.

The signal controller 100 calculates an image parameter from the image signal ImS and generates any one of the first to sixth driving control signals CONT1' to CONT6' for the short period light emitting and the first to sixth driving control signals CONT1" to CONT6" for the long period light emitting by using the image parameter. The first to sixth driving control signals CONT1' to CONT6' for the short period light emitting are signals controlling the light emitting period in which a plurality of pixels emit the light during one frame as the first period, and the first to sixth driving control signals CONT1" to CONT6" for the long period light emitting are signals controlling the light emitting period in which a plurality of pixels emit the light during one frame as the second period. A length of the second period is longer than the length of the first period. A detailed description thereof will be described below.

The signal controller 100 generates the image data signal ImD by dividing the image signal ImS into a frame unit according to the vertical synchronization signal Vsync and dividing the image data signal ImS into a scan line unit according to the horizontal synchronization signal Hsync. The signal controller 100 transmits the image data signal ImD along with the first driving control signal CONT1 to the data driver 300.

The display unit 800 includes a display area including a plurality of pixels. A plurality of scan lines may be substantially extended in a row direction and substantially parallel with each other and a plurality of data lines and a plurality of power lines may be substantially extended in a column direction and substantially parallel with each other are formed in the display unit 800. The scan lines, the data lines, and the power lines are coupled to the plurality of pixels. The plurality of pixels may be arranged substantially in a matrix format.

The scan driver 200 is coupled to a plurality of scan lines and generates a plurality of scan signals S[1]-S[n] according to the second driving control signal CONT2. The scan driver 200 may sequentially apply the scan signals S[1]-S[n] of the gate-on voltage to a plurality of scan lines.

The data driver 300 is coupled to a plurality of data lines through the MUX unit 700. The data driver 300 samples and holds the image data signal ImD input according to the first driving control signal CONT1, and transmits a plurality of data signals data[1]-data[m] to a plurality of data lines. The data driver 300 applies the data signals data[1]-data[m] having a predetermined voltage range to a plurality of data lines by corresponding to the scan signals S[1]-S[n] of the gate-on voltage.

The power supply unit 400 determines a level of the first power source voltage ELVDD and the second power source voltage ELVSS according to the third driving control signal CONT3 to supply the level to the power source line coupled to a plurality of pixels. The first power source voltage ELVDD and the second power source voltage ELVSS provide the driving current of the pixel.

The compensation control signal unit 500 determines the level of the compensation control signal GC according to the fourth driving control signal CONT4 to apply it to a compensation control line coupled to a plurality of pixels.

The storage power supply unit 600 is coupled to a plurality of data lines through the MUX unit 700, and determines the level of the first sustain voltage Vsusg according to the fifth driving control signal CONT5 to apply it to a plurality of data lines.

The MUX unit 700 connects one of the data driver 300 and the sustain power supply unit 600 to a plurality of data lines according to the sixth driving control signal CONT6. That is, the MUX unit 700 applies one of the data signals data[1]-data[m] and the first sustain voltage Vsusg to a plurality of data lines. The sixth driving control signal CONT6 may be referred to as a sustain voltage enable signal SUS_ENB applying the first sustain voltage Vsusg to a plurality of data lines.

Figure 2:
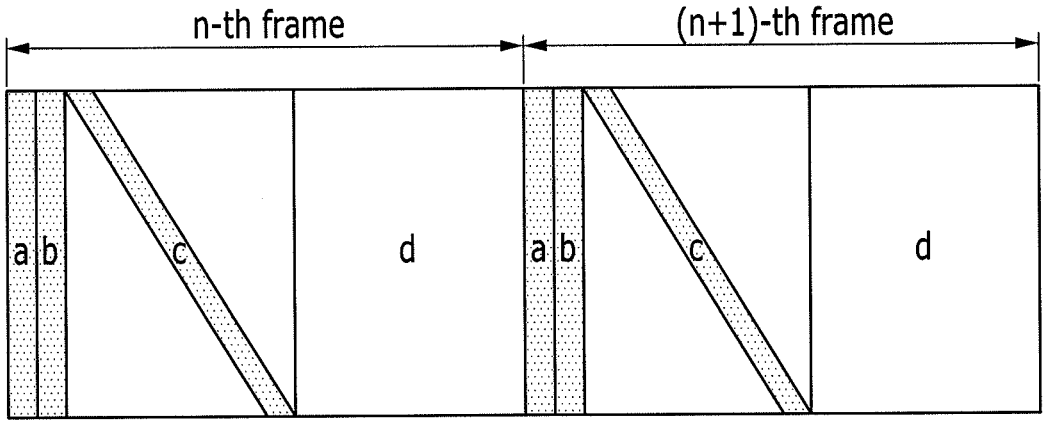
FIG. 2 is a view of a driving operation of a simultaneous light emitting method of a display device according to an example embodiment.

FIG. 2 is a diagram showing an operation of a simultaneous light emitting method of a display device according to an example embodiment.

In the example embodiment shown in FIG. 2, the display device 10 according to the present example embodiment is described as being applied to an organic light emitting diode display using an organic light emitting diode, but it may be applied to various display devices.

One frame period in which one image is displayed to the display unit 800 includes a reset period (a) resetting the driving voltage of the organic light emitting diode (OLED) of the pixel, a compensation period (b) compensating a threshold voltage of a driving transistor of the pixel, a scan period (c) in which the data signal is transmitted to a plurality of pixels, and a light emitting period (d) in which a plurality of pixels emit the light corresponding to the transmitted data signal.

The operation in the scan period (c) is sequentially performed for each scan line, however the display operation of the reset period (a), the compensation period (b), and the light emitting period (d) are simultaneously and totally performed in the entire display unit 600.

Figure 3:
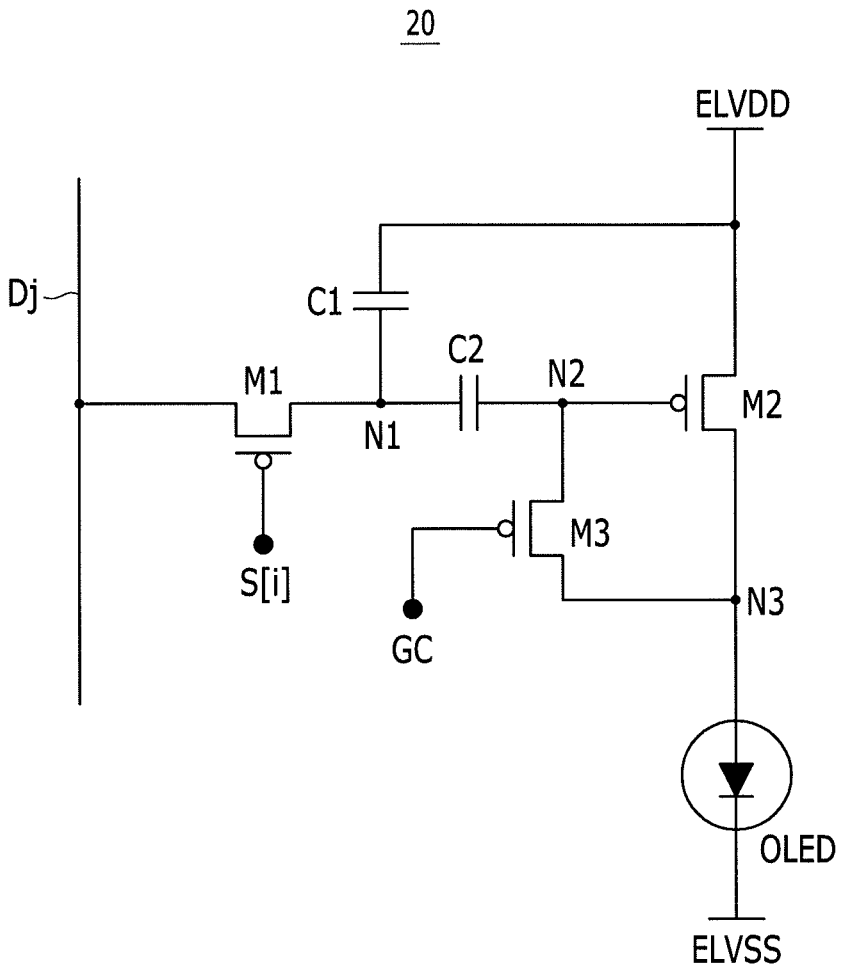
FIG. 3 is a circuit diagram of a pixel according to an example embodiment.

FIG. 3 is a circuit diagram of a pixel according to an example embodiment. It shows one pixel of a plurality of pixels included in the display device of FIG. 1.

In the example embodiment shown in FIG. 3, a pixel 20 includes a switching transistor M1, a driving transistor M2, a compensation transistor M3, a storage capacitor C1, a compensation capacitor C2, and an organic light emitting diode (OLED).

The switching transistor M1 includes a gate electrode coupled to the scan line, one electrode coupled to the data line Dj, and the other electrode coupled to the first node N1. The switching transistor M is turned on by the scan signal S[i] of the gate-on voltage Von applied to the scan line such that the voltage applied to the data line Dj is transmitted to the first node N1.

The driving transistor M2 includes the gate electrode coupled to the second node N2, one electrode coupled to the first power source voltage ELVDD, and the other electrode coupled to the third node N3. The third node N3 is coupled to an anode of the organic light emitting diode (OLED). The driving transistor M2 controls the driving current supplied to the organic light emitting diode (OLED) from the first power source voltage ELVDD.

The compensation transistor M3 includes the gate electrode coupled to the compensation control line, one electrode coupled to the second node N2, and the other electrode coupled to the third node N3. The compensation transistor M3 is turned on by the compensation control signal GC of the gate-on voltage applied to the compensation control line coupled to the gate electrode of the driving transistor M2 and the other electrode.

The storage capacitor C1 includes one electrode coupled to the first node and the other electrode coupled to the first power source voltage ELVDD.

The compensation capacitor C2 includes one electrode coupled to the second node N2 and the other electrode coupled to the first node N1.

The organic light emitting diode (OLED) includes the anode coupled to the third node N3 and the cathode coupled to the second power source voltage ELVSS. The organic light emitting diode (OLED) can emit one color of light of primary colors. As examples of the primary colors, there may be three primary colors of red, green, and blue, and a desired color is displayed by a spatial or temporal sum of these three primary colors.

The switching transistor M1, the driving transistor M2, and the compensation transistor M3 may be p-channel field effect transistors. Here, the gate-on voltage turning on the switching transistor M1, the driving transistor M2, and the compensation transistor M3 is a logic low level voltage, and the gate-off voltage turning them off is a logic high level voltage.

The switching transistor M1, the driving transistor M2, and the compensation transistor M3 are shown as p-channel field effect transistors, but one or more of the switching transistor M1, the driving transistor M2, and the compensation transistor M3 may be an n-channel field effect transistor. In this case, the gate-on voltage for turning on the n-channel electric field effect transistor is the logic high voltage, while the gate-off voltage for turning it off is the logic low voltage.

The circuit structure of the pixel 20 is merely an example embodiment, and the display device 10 of FIG. 1 may include a pixel having a different circuit structure.

Figure 4:
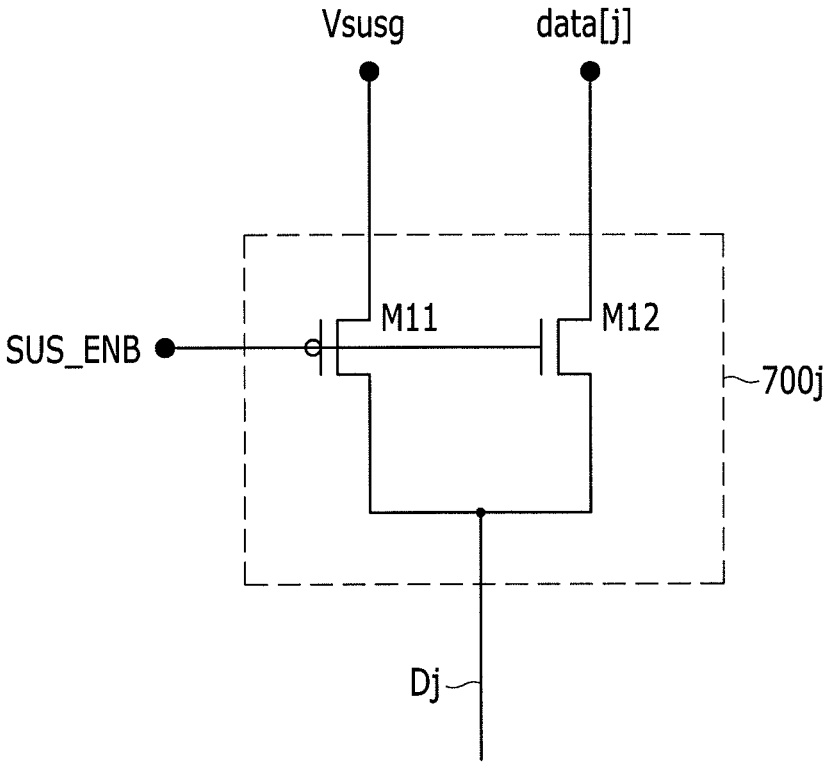
FIG. 4 is a block diagram of one example of a MUX unit included in the display device of FIG. 1.

FIG. 4 is a block diagram of one example of a MUX unit included in the display device of FIG. 1.

In the example embodiment shown in FIG. 4, the MUX unit 700 includes a plurality of unit MUXs 700*j* respectively coupled to a plurality of data lines ($1 \leq j \leq m$).

The unit MUX 700*j* includes the first transistor M11 and the second transistor M12.

The first transistor M11 includes the gate electrode applied with the sixth driving control signal CONT6, that is, the sustain voltage enable signal SUS_ENB, one electrode coupled to the sustain power supply unit 600 and applied with the first sustain voltage Vsusg, and the other electrode coupled to the data line Dj.

The second transistor M12 includes the gate electrode applied with the sustain voltage enable signal SUS_ENB, one electrode coupled to the data driver 300 and applied with the data signal data[j], and the other electrode coupled to the data line Dj.

The first transistor M11 may be the p-channel field effect transistor, and the second transistor M12 may be the n-channel field effect transistor. Also, the second transistor M12 is turned on by the sustain voltage enable signal SUS_ENB of the logic high level to apply the data signal data[j] to the data line Dj, and at this time, the first transistor M11 is turned off.

Here, the first transistor M11 is the p-channel field effect transistor and the second transistor M12 is the n-channel field effect transistor, while in contrast, the first transistor M11 may be the n-channel field effect transistor, and the second transistor M12 may be the p-channel field effect transistor.

Next, the driving method of the display device 10 by the first to sixth driving control signals CONT1' to CONT6' for the short period light emitting will be described with reference to FIG. 5, and the driving method of the display device 10 by the first to sixth driving control signals CONT1" to CONT6" for the long period light emitting will be described with reference to FIG. 6.

Figure 5:
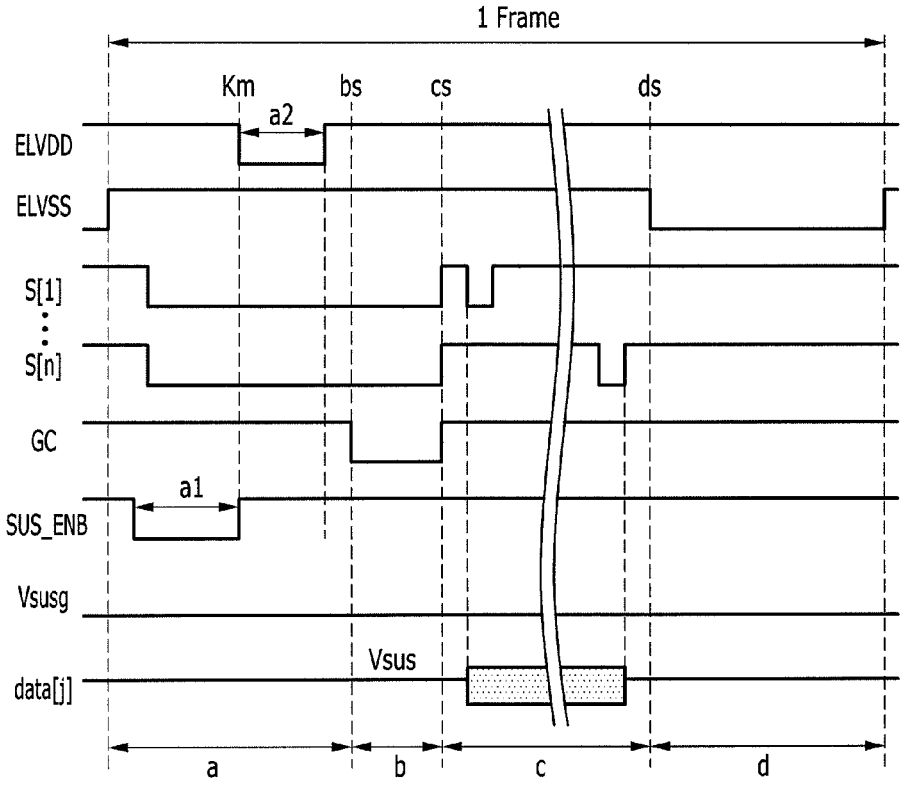
FIG. 5 is a timing diagram of a driving method of a display device according to an example embodiment.

FIG. 5 is a timing diagram of a driving method of a display device according to an example embodiment.

Referring to FIGS. 1 to 5, the driving method of the display device 10 by the first to sixth driving control signals CONT1' to CONT6' for the short period light emitting that are generated by the signal controller 100 is provided.

The first power source voltage ELVDD and the second power source voltage ELVSS are controlled by the third driving control signal CONT3' for the short period light emitting transmitted to the power supply unit 400. A plurality of scan signals S[1]-S[n] are controlled by the second driving control signal CONT2' for the short period light emitting transmitted to the scan driver 200. The compensation control signal GC is controlled by the fourth driving control signal CONT4' for the short period light emitting transmitted to the compensation control signal unit 500. The sustain voltage enable signal SUS_ENB is the sixth driving control signal CONT6' for the short period light emitting supplied to the MUX unit 700. The first sustain voltage Vsusg is controlled by the fifth driving control signal CONT5' for the short period light emitting transmitted to the storage power supply unit 600. The data signal data[j] is controlled by the second driving control signal CONT2' for the short period light emitting transmitted to the data driver 300.

One frame in which the display device 10 is driven by the first to sixth driving control signals CONT1' to CONT6' for the short period light emitting includes a reset period (a), a compensation period (b), a scan period (c), and a light emitting period (d). The reset period (a) includes a first reset period a1 and a second reset period a2.

During the first reset period a1, the first power source voltage ELVDD and the second power source voltage ELVSS are applied as the high level voltage, a plurality of scan signals S[1]-S[n] are applied as the gate-on voltage, and the sustain voltage enable signal SUS_ENB is applied as the low level voltage. The sustain voltage enable signal SUS_ENB is applied as the low level voltage such that the data line Dj is applied with the first sustain voltage Vsusg. As a plurality of scan signals S[1]-S[n] are applied as the gate-on voltage, the switching transistor M1 is turned on and the first sustain voltage Vsusg is transmitted to the first node N1. The voltage of the first node N1 is changed from the data voltage Vdat that is applied in the scan period of the previous frame to the first sustain voltage Vsusg, and the voltage change amount of the first node N1 becomes Vsusg-Vdat. The voltage of the second node N2 is changed by the voltage change amount of the first node N1 due to the coupling by the compensation capacitor C2. The voltage of the second node N2 becomes a state of ELVDD+Vth+(Vdat−Vsus) in the scan period of the previous frame. This will be described later in a description for the scan period (c). The voltage of the second node N2 becomes ELVDD+Vth+(Vdat−Vsus)+(Vsusg−Vdat)=ELVDD+Vth−Vsus+Vsusg according to the voltage change of the first node N1. Here, ELVDD means the first power source voltage ELVDD, Vth means a threshold voltage of the driving transistor M2, and Vsus means the second sustain voltage applied to the plurality of data lines by the data driver 300 in a period other than the scan period (c). As described above, the first reset period a1 is a period for resetting the gate voltage of the driving transistor M2 into ELVDD+Vth−Vsus+Vsusg to remove hysteresis. The first reset period a1 in which the sustain voltage enable signal SUS_ENB is applied as the low level voltage is determined by the sixth driving control signal CONT6' for the short period light emitting applied to the MUX unit 700.

During the second reset period a2, the second power source voltage ELVSS maintains the high level voltage and the first power source voltage ELVDD is changed into the low level voltage. A plurality of scan signals S[1]-S[n] are maintained as the gate-on voltage and the sustain voltage enable signal SUS_ENB is applied as the high level voltage. The sustain voltage enable signal SUS_ENB is applied as the high level voltage such that the data line Dj is applied with the second sustain voltage Vsus. As a plurality of scan signals S[1]-S[n] are applied as the gate-on voltage, the switching transistor M1 is turned on and the second sustain voltage Vsus is transmitted to the first node N1. The voltage of the first node N1 is changed from the first sustain voltage Vsusg to the second sustain voltage Vsus, and the voltage change amount of the first node N1 becomes Vsus-Vsusg. The voltage of the second node N2 is changed by the voltage change amount of the first node N1 due to the coupling by the compensation capacitor C2. In the state that the voltage of the second node N2 is ELVDD+Vth−Vsus+Vsusg, the voltage of the second node N2 becomes ELVDD+Vth−Vsus+Vsusg+(Vsus−Vsusg)=ELVDD+Vth according to the voltage change of the first node N1. That is, during the second reset period a2, the gate voltage of the driving transistor M2 is reset as the voltage ELVDD+Vth. Also, as the voltage difference of the first power source voltage ELVDD and the second power source voltage ELVSS is reversed, the anode voltage of the organic light emitting diode (OLED) is higher than the first power source voltage ELVDD, and the anode of the organic light emitting diode (OLED) becomes the source in an aspect of the driving transistor M2. The gate voltage of the driving transistor M2 is ELVDD+Vth. The driving transistor M2 is turned on according to the voltage difference of the gate-source voltage, and the current flows from the anode of the organic light emitting diode (OLED) to the first power source voltage ELVDD through the driving transistor M2. Here, the current flowing through the driving transistor M2 flows until the anode voltage of the organic light emitting diode (OLED) reaches the ELVDD of the low level voltage. That is, during the second reset period a2, the anode voltage of the organic light emitting diode (OLED) is reset as the ELVDD of the low level voltage. If the second reset period a2 is finished, the first power source voltage ELVDD is converted into the high level voltage.

A time of the second reset period a2, that is, a time that the first power source voltage ELVDD is decreased into the low level voltage, is referred to as Km. The time Km at which the power supply unit 400 decreases the first power source voltage ELVDD into the low level voltage is determined by the third driving control signal CONT3' for the short period light emitting transmitted to the power supply unit 400. Also, the time at which the second reset period a2 is finished and the power supply unit 400 applies the first power source voltage ELVDD as the high level voltage is determined by the third driving control signal CONT3' for the short period light emitting.

During the compensation period (b), a plurality of scan signals S[1]-S[n]) and the compensation control signal GC are applied as the gate-on voltage. The first power source voltage ELVDD and the second power source voltage ELVSS are applied as the high level voltage. The sustain voltage enable signal SUS_ENB is applied as the high level voltage, and the data line Dj is applied with the data signal data[j] of the second sustain voltage Vsus. As a plurality of scan signals S[1]-S[n] have the gate-on voltage, the switching transistor M1 is turned on and the second sustain voltage Vsus is transmitted to the first node N1. As the compensation control signal GC is applied as the gate-on voltage, the compensation transistor M3 is turned on, and the driving transistor M2 is diode-coupled. As the driving transistor M2 is diode-coupled, the voltage of the third node N3 becomes the same voltage as the first power source voltage ELVDD. Also, the gate voltage of the driving transistor M2, that is, the voltage of the second node N2, becomes ELVDD+Vth. The compensation transistor C2 stores the voltage ELVDD+Vth−Vsus. As above-described, during the compensation period (b), the compensation capacitor C2 stores the voltage ELVDD+Vth−Vsus reflecting the threshold voltage Vth of the driving transistor M2. After the compensation period (b), the compensation control signal GC and a plurality of scan signals S[1]-S[n] are converted into the gate-off voltage. The compensation transistor M3 and the switching transistor M1 are turned off, and the voltage ELVDD+Vth−Vsus stored to the compensation capacitor C2 is maintained.

A time of the compensation period (b), that is, the time that the compensation control signal GC is changed into the gate-on voltage, is referred to as bs. Also, an ending time of the compensation period (b), that is, the time that the compensation control signal GC is changed into the gate-off voltage, is referred to as cs. The time bs at which the compensation control signal unit 500 applies the compensation control signal GC as the gate-on voltage and the time cs that applies as the gate-off voltage are determined by the fourth driving control signal CONT4' for the short period light emitting transmitted to the compensation control signal unit 500.

During the scan period (c), a plurality of scan signals S[1]-S[n] are sequentially applied as the low level voltage to turn on the switching transistor M1. The first power source voltage ELVDD and the second power source voltage ELVSS maintain the high level voltage. The sustain voltage enable signal SUS_ENB is applied as the high level voltage and the data line Dj is applied with the data signal data[j]. The data signal data[j] is applied as the data voltage Vdat having a predetermined voltage range. As the switching transistor M1 is turned on, the data voltage Vdat is transmitted to the first node N1. The voltage of the first node N1 is changed from the second sustain voltage Vsus into the data voltage Vdat, and the voltage change amount of the first node N1 becomes Vdat−Vsus. The storage capacitor C1 stores the data voltage Vdat of the first node N1. The voltage of the second node N2 is changed by the voltage change amount Vdat−Vsus of the first node N1 thereby being changed into ELVDD+Vth+(Vdat−Vsus) by the coupling of the compensation capacitor C2. That is, the gate voltage of the driving transistor M2 reflects the data voltage Vdat.

The ending time cs of the compensation period (b) may be the start time of the scan period (c). The time cs of the scan period (c) when the scan driver 200 sequentially applies a plurality of scan signals S[1]-S[n] as the low level voltage is determined by the second driving control signal CONT2' for the short period light emitting transmitted to the scan driver 200.

During the light emitting period (d), the first power source voltage ELVDD maintains the high level voltage and the second power source voltage ELVSS is changed into the low level voltage. A plurality of scan signals S[1]-S[n] and the compensation control signal GC are applied as the gate-off voltage, and the data signal data[j] is applied as the second sustain voltage Vsus. As the second power source voltage ELVSS is converted into the low level voltage, the current flows to the organic light emitting diode (OLED) through the driving transistor M2. The current flowing through the driving transistor M2 becomes $Ioled=\beta/2(Vgs-Vth)^2=\beta/2[\{ELVDD+Vth+(Vdat-Vsus)-ELVDD\}-Vth]^2=\beta/2(Vdat-Vsus)^2$. Here, β is a parameter determined according to a characteristic of the driving transistor M2. That is, the driving transistor M2 transmits the current corresponding to the data voltage Vdat to the organic light emitting diode (OLED). The organic light emitting diode (OLED) emits the light with the brightness corresponding to the current flowing to the driving transistor M2. Resultantly, the current flowing to the organic light emitting diode (OLED) does not affect the threshold voltage deviation of the driving transistor M2 and the voltage drop of the first power source voltage ELVDD.

A time of the light emitting period (d), that is, the time that the second power source voltage ELVSS is decreased from the high level voltage to the low level voltage, is referred to as ds. The time ds when the power supply unit 400 decreases the second power source voltage ELVSS into the low level voltage may be determined by the third driving control signal CONT3' for the short period light emitting transmitted to the power supply unit 400.

Figure 6:
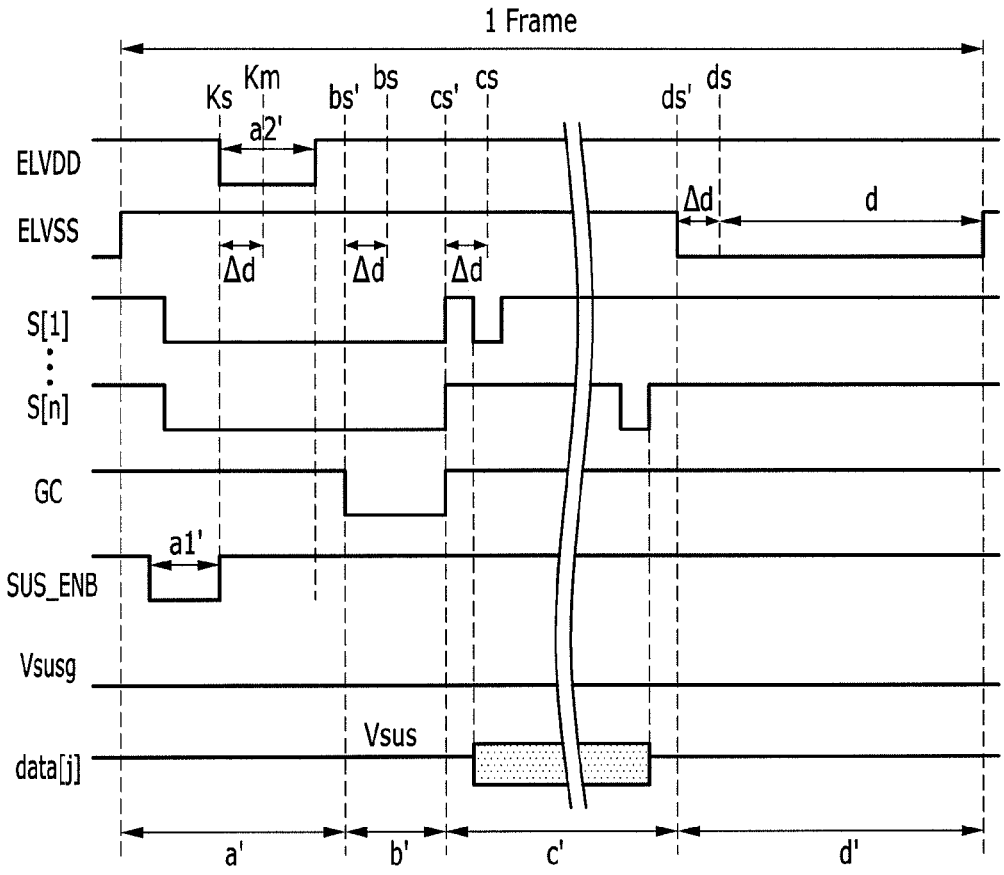
FIG. 6 is a timing diagram of a driving method of a display device according to another example embodiment.

FIG. 6 is a timing diagram of a driving method of a display device according to another example embodiment.

Referring to FIGS. 1 to 6, a driving method of a display device 10 by the first to sixth driving control signals CONT1" to CONT6" for the long period light emitting generated by the signal controller 100 is provided.

The first power source voltage ELVDD and the second power source voltage ELVSS are controlled by the third driving control signal CONT3" for the long period light emitting transmitted to the power supply unit 400. A plurality of scan signals S[1]-S[n] are controlled by the second driving control signal CONT2" for the long period light emitting transmitted to the scan driver 200. The compensation control signal GC is controlled by the fourth driving control signal CONT4" for the long period light emitting transmitted to the compensation control signal unit 500. The sustain voltage enable signal SUS_ENB is the sixth driving control signal CONT6" for the long period light emitting supplied to the MUX unit 700. The first sustain voltage Vsusg is controlled by the fifth driving control signal CONT5" for the long period light emitting transmitted to the storage power supply unit 600. The data signal data[j] is controlled by the second driving control signal CONT2" for the long period light emitting transmitted to the data driver 300.

One frame in which the display device 10 is driven by the first to sixth driving control signals CONT1" to CONT6" for the long period light emitting includes a reset period (a'), a compensation period (b'), a scan period (c'), and a light emitting period (d'). The reset period (a') includes a first reset period a1' and a second reset period a2'.

The operation of the display device 10 by the long period light emitting by the first to sixth driving control signals CONT1" to CONT6" is the same as the operation of the display device 10 by the first to sixth driving control signals CONT1' to CONT6' for the short period light emitting described in FIG. 5 except for differences of the operation time.

When the time of the second reset period (a2') is referred to as Ks, Ks is earlier than the time Km of the second reset period a2 of FIG. 5 by the period Δd. That is, the time Ks when the first power source voltage ELVDD is decreased into the low level voltage by the third driving control signal CONT3" for the long period light emitting is earlier than the time Km when the first power source voltage ELVDD is decreased into the low level voltage by the third driving control signal CONT3' for the short period light emitting of FIG. 5 by the period Δd. At this time, the time of the first reset period (a1') is the same as the time of the first reset period a1 of FIG. 5, and the ending time of the first reset period (a1') is earlier than the ending time of the first reset period a1 of FIG. 5 by the period Δd.

That is, the reset period (a') according to the first to sixth driving control signals CONT1" to CONT6" for the long period light emitting is shorter than the reset period (a) according to the first to sixth driving control signals CONT1' to CONT6' for the short period light emitting by the period Δd.

When the time of the compensation period (b') is referred to as bs', bs' is earlier than the time bs of the compensation period (b) of FIG. 5 by the period Δd. That is, the time bs' of the compensation period b' when the compensation control signal GC is decreased into the low level voltage by the fourth driving control signal CONT4" for the long period light emitting is earlier than the time bs when the compensation control signal GC is decreased into the low level voltage by the fourth driving control signal CONT4' for the short period light emitting of FIG. 5 by the period Δd.

When a time of the scan period (c') is referred to as cs', cs' is earlier than the time cs of the scan period (c) of FIG. 5 by the period Δd. That is, the time cs' of the scan period (c') when a plurality of scan signals S[1]-S[n]) are sequentially applied as the gate-on voltage by the second driving control signal CONT2" for the long period light emitting is earlier than the time cs of the scan period (c) when a plurality of scan signals S[1]-S[n]) are sequentially applied as the gate-on voltage by the second driving control signal CONT2' for the short period light emitting of FIG. 5 by the period Δd.

When the time of the light emitting period (d') is referred to as ds', ds' is earlier than the time ds of the light emitting period (d) of FIG. 5 by the period Δd. That is, the time ds' when the second power source voltage ELVSS is decreased into the low level voltage by the third driving control signal CONT3" for the long period light emitting is earlier than the time ds when the second power source voltage ELVSS is decreased into the low level voltage by the third driving control signal CONT3' for the short period light emitting of FIG. 5 by the period Δd. At this time, the ending time of the light emitting period (d') is the ending time of the light emitting period (d) of FIG. 5.

Compared with FIG. 5, resultantly, the first reset period (a1') is shortened by the period Δd and the light emitting period (d') is elongated by the period Δd. At this time, each length of the second reset period (a2'), the compensation period (b'), and the scan period (c') is maintained to be the same as each length of the second reset period a2, the compensation period (b), and the scan period (c) of FIG. 5, and the starting point is only advanced by the period Δd. That is, the light emitting period (d) is reduced according to the first to sixth driving control signals CONT1' to CONT6' for the short period light emitting, or the light emitting period (d') is increased according to the first to sixth driving control signals CONT1" to CONT6" for the long period light emitting.

Next, a method in which the signal controller 100 generates one of the first to sixth driving control signals CONT1' to CONT6' for the short period light emitting and the first to sixth driving control signals CONT1" to CONT6" for the long period light emitting to generate the light emitting period will be described.

Figure 7:
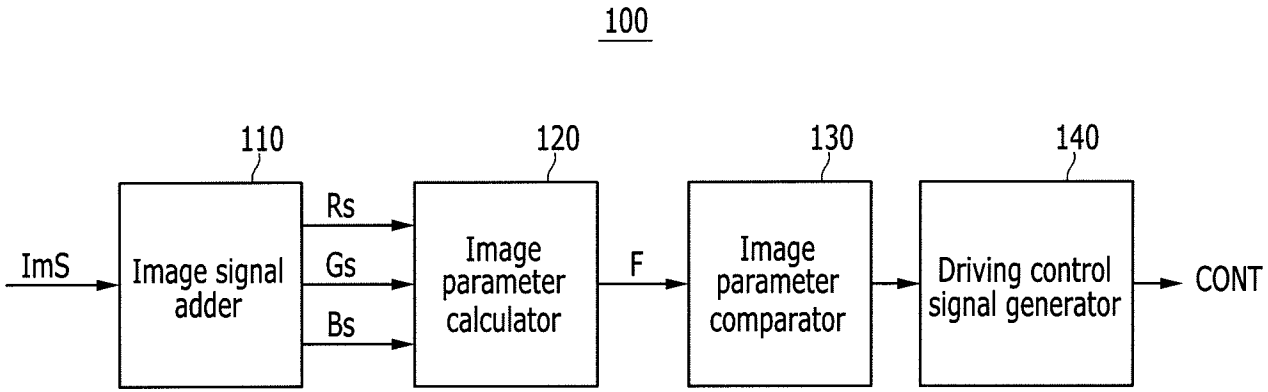
FIG. 7 is a block diagram of a signal controller according to an example embodiment.

FIG. 7 is a block diagram of a signal controller according to an example embodiment.

In the example embodiment shown in FIG. 7, the signal controller 100 includes an image signal adder 110, an image parameter calculator 120, an image parameter comparator 130, and a driving control signal generator 140.

It is assumed that a plurality of pixels included in the display unit 800 include a red pixel emitting red light, a green pixel emitting green light, and a blue pixel emitting blue light. At this time, the grayscale data image signal ImS includes grayscale data (R) for the red pixel, grayscale data (G) for the green pixel, and grayscale data (B) for the blue pixel.

The image signal adder 110 adds the grayscale data of the image signal ImS input from the external device by a frame unit to calculate a grayscale data sum. That is, the image signal adder 110 respectively adds the grayscale data (R) for the red pixel, the grayscale data (G) of the green pixel, and the grayscale data (B) of the blue pixel that are included in the image signal ImS by the frame unit. The image signal adder 110 transmits the grayscale data sum Rs of the red pixel, the grayscale data sum Gs of the green pixel, and the grayscale data sum Bs of the blue pixel to the image parameter calculator 120.

The image parameter calculator 120 multiplies a current contribution rate of the display device 10 to the grayscale data sum that is added by the frame unit to calculate an image parameter F. The current contribution rate means a ratio of the current respectively flowing to the red pixel, the green pixel, and the blue pixel for the total among the current flowing to a plurality of pixels when a plurality of pixels included in the display unit 800 emit white light. When a current contribution rate of the red pixel is referred to as $\alpha'$, a current contribution rate of the green pixel is referred to as $\beta'$, and a current contribution rate of the blue pixel is referred to as $\gamma'$, it is that $1=\alpha'+\beta'+\gamma'$.

The image parameter is calculated as $F=\alpha'\times Rs+\beta'\times Gs+\gamma'\times Bs$. That is, the image parameter calculator 120 calculates the sum of the values calculated by multiplying the corresponding current contribution rate to the grayscale data sum Rs of the red pixel, the grayscale data sum Gs of the green pixel, and the grayscale data sum Bs of the blue pixel as the image parameter F.

The image parameter comparator 130 compares the image parameter F with the first threshold value. The first threshold value is a predetermined value to determine decreasing/increasing of the light emitting period of the corresponding frame. When the image parameter F is larger than the first threshold value, the image of the current frame means an image that is relatively bright, and when the image parameter F is smaller than the first threshold value, the image of the current frame means an image that is relatively dark.

The image parameter comparator 130 stores a value (Count=Count+1) that 1 is added to a control parameter Count if the image parameter F is larger than the first threshold value, and it stores a value (Count=0) that the control parameter Count is 0 if the parameter F is smaller than the first threshold value.

The image parameter comparator 130 stores a value (Count=Count+1) that 1 is added to a control parameter Count and then determines whether the control parameter Count is larger than 1. The case that the control parameter Count is 1 is a case in which the image parameter of the previous frame is smaller than the first threshold value such that the control parameter Count is stored as 0. That is, it means that the image of the previous frame is an image that is relatively dark. When the control parameter Count is larger than 1, that is, the case that the control parameter Count is larger than 2, means that the image of the previous frame is an image that is relatively bright.

When the control parameter Count is larger than 1, the image parameter comparator 130 transmits the first signal generating the driving control signals CONT1" to CONT6" for the long period light emitting to the driving control signal generator 140.

When the image parameter F is smaller than the first threshold value or the control parameter Count is equal to or less than 1, the image parameter comparator 130 transmits the second signal generating the driving control signals CONT1' to CONT6' for the short period light emitting to the driving control signal generator 140.

The driving control signal generator 140 generates the driving control signals CONT1" to CONT6" for the long period light emitting according to the first signal. The driving control signal generator 140 generates the driving control signals CONT1' to CONT6' for the long period light emitting according to the second signal.

Meanwhile, the image parameter calculator 120 may store the image parameter Fn−1 of the previous frame and calculate a deviation ΔF of the image parameter Fn that is calculated in the current frame and the image parameter Fn−1 of the previous frame. Also, the image parameter comparator 130 may compare the deviation ΔF of the image parameter with the second threshold value. The second threshold value is a predetermined value to determine the increasing/decreasing of the light emitting period of the corresponding frame. The driving control signal generator 140 may generate the driving control signal increasing and decreasing the light emitting period of the corresponding frame according to the comparison result of the deviation ΔF of the image parameter and the second threshold value.

Meanwhile, the image signal ImS may include a 3D index instructing 3D driving. When the 3D index instructs the 3D driving of the display device 10 (3D index=1), the driving control signal generator 140 may generate one of the driving control signals CONT1' to CONT6' for the short period light emitting and the driving control signals CONT1" to CONT6" for the long period light emitting. That is, if the 3D index instructs the 3D driving of the display device 10 (3D index=1), as described above, the image signal adder 110, the image parameter calculator 120, the image parameter comparator 130, and the driving control signal generator 140 are operated to generate one of the driving control signals CONT1' to CONT6' for the short period light emitting and the driving control signals CONT1" to CONT6" for the long period light emitting.

When the 3D index instructs 2D driving of the display device 10 (3D index=0), the driving control signal generator 140 may always generate the first to sixth driving control signals CONT1" to CONT6" for the long period light emitting. That is, if the 3D index instructs the 2D driving of the display device 10 (3D index=0), without the operation of the image signal adder 110, the image parameter calculator 120, and the image parameter comparator 130, the first signal generating the first to sixth driving control signals CONT1" to CONT6") for the long period light emitting may be directly transmitted to the driving control signal generator 140.

Figure 8:
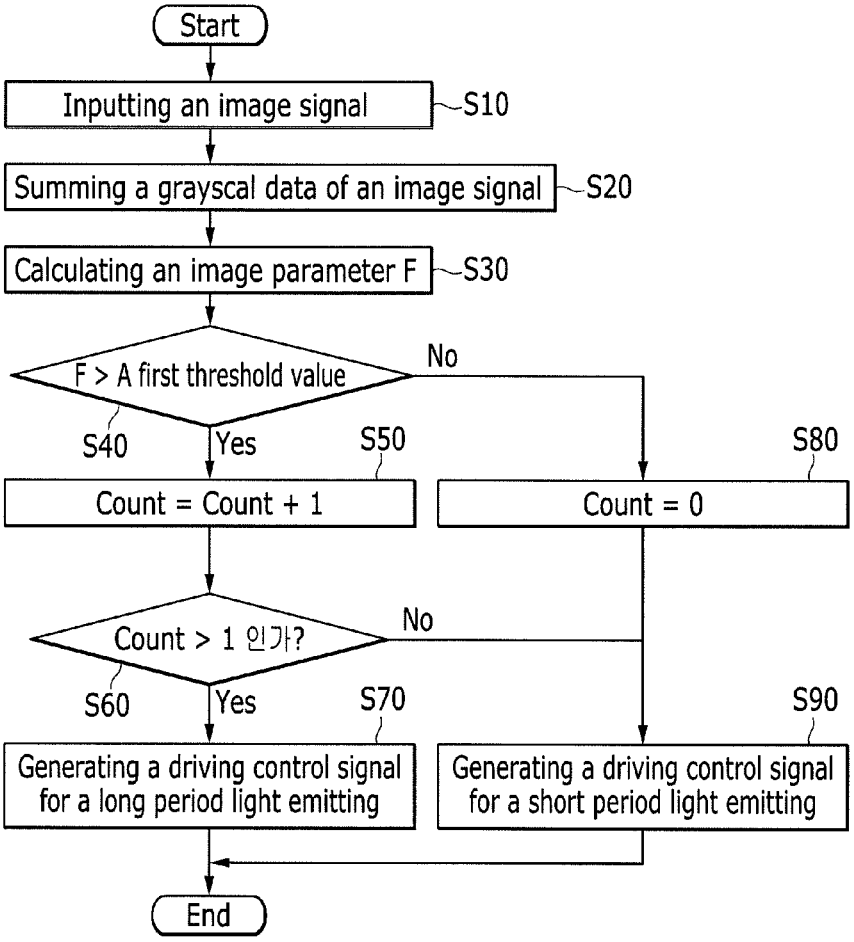
FIG. 8 is a flowchart of a driving method of a signal controller according to an example embodiment.

FIG. 8 is a flowchart of a driving method of a signal controller according to an example embodiment.

In the example embodiment shown in FIG. 8, the image signal ImS is input from the external device S10.

The grayscale data of the image signal ImS is added by the frame unit S20. That is, the grayscale data sum (Rs) of the red pixel, the grayscale data sum (Gs) of the green pixel, and the grayscale data sum (Bs) of the blue pixel are calculated by the frame unit.

The current contribution rate is multiplied by the grayscale data sum that is added to the frame unit to calculate the image parameter F S30. The current contribution rate includes the current contribution rate $\alpha'$ of the red pixel, the current contribution rate $\beta'$ of the green pixel, and the current contribution rate $\gamma'$ of the blue pixel. The corresponding current contribution rate is respectively multiplied to the grayscale data sum (Rs) of the red pixel, the grayscale data sum (Gs) of the green pixel, and the grayscale data sum (Bs) of the blue pixel to calculate the image parameter $F=\alpha'\times Rs+\beta'\times Gs+\gamma'\times Bs$.

It is determined whether the image parameter F is larger than the first threshold value S40.

When the image parameter F is larger than the first threshold value, the control parameter Count is added by 1 and is stored S50.

When the image parameter F is not larger than the first threshold value, the control parameter Count is stored as 0 S80. In other words, when the image parameter F is equal to or less than the first threshold value, the control parameter Count is stored as 0.

After the control parameter Count is stored to be added by 1, it is determined whether the control parameter Count is larger than 1 S60. The case that the control parameter Count is 1 is a case that the image parameter of the previous frame is smaller than the first threshold value such that the control parameter Count is stored as 0. That is, it means that the image of the previous frame is an image that is relatively dark. When the control parameter Count is larger than 1, that is, the case that the control parameter Count is more than 2, means that the image of the previous frame is an image that is relatively bright.

When the control parameter Count is larger than 1, the driving control signals CONT1" to CONT6" for the long period light emitting are generated S70. That is, when the image of the previous frame and the image of the current frame are each an image that is relatively bright, the driving control signals CONT1" to CONT6" for the long period light emitting are generated, and accordingly the image of the current frame is displayed in the light emitting period (d') of the long cycle. When the image of the previous frame is an image that is relatively bright, although the first reset period (a1') resetting the gate voltage of the driving transistor is short, the gate voltage of the driving transistor may be sufficiently reset and the light emitting period (d') is increased by the period in which the first reset period (a1') is decreased thereby increasing the luminance of the image of the current frame.

When the image parameter F is not larger than the first threshold value such that the control parameter Count is stored as 0 or the control parameter Count is equal to or less than 1, the driving control signals CONT1' to CONT6' for the short period light emitting are generated S90. That is, when the image of the current frame is an image that is relatively dark, the driving control signals CONT1' to CONT6' for the short period light emitting are generated, and accordingly the image of the current frame is displayed during the light emitting period (d) of the short cycle. This is because the light emitting period is increased when the image of the current frame is an image that is relatively dark such that it is not necessary to increase the luminance of the image.

Also, although the image of the current frame is an image that is relatively bright, when the image of the previous frame is an image that is relatively dark, the driving control signals CONT1' to CONT6' for the short period light emitting are generated, and accordingly the image of the current frame is displayed during the light emitting period (d) of the short cycle. Thus, the first reset period a1 is maintained to be long to sufficiently reset the gate voltage of the driving transistor when the image of the previous frame is an image that is relatively dark.

Figure 9:
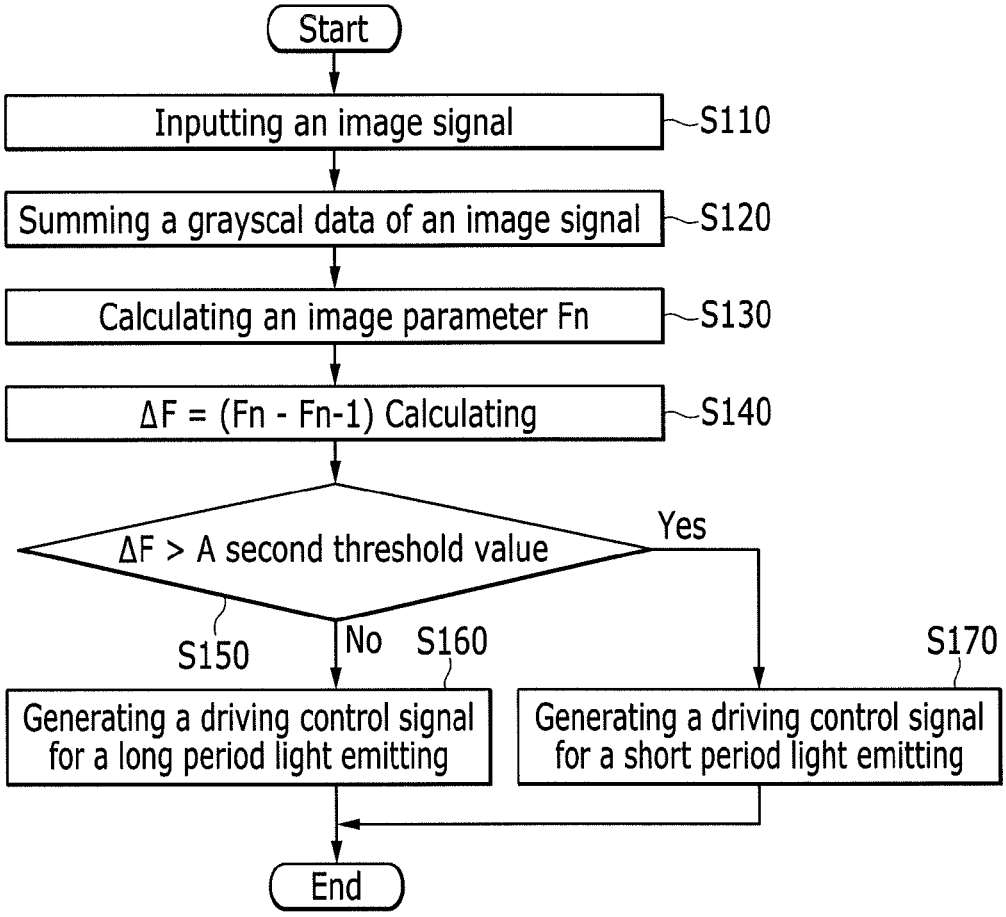
FIG. 9 is a flowchart of a driving method of a signal controller according to another example embodiment.

FIG. 9 is a flowchart of a driving method of a signal controller according to another example embodiment.

In the example embodiment shown in FIG. 9, the image signal ImS is input from the external device S110.

The grayscale data of the image signal ImS is added by the frame unit S120. That is, the grayscale data sum (Rs) of the red pixel, the grayscale data sum (Gs) of the green pixel, and the grayscale data sum (Bs) of the blue pixel are calculated by the frame unit.

The current contribution rate is multiplied by the grayscale data sum that is added by the frame unit to calculate the image parameter Fn S30. The current contribution rate includes the current contribution rate $\alpha'$ of the red pixel, the current contribution rate $\beta'$ of the green pixel, and the current contribution rate $\gamma'$ of the blue pixel. The corresponding current contribution rate is respectively multiplied by the grayscale data sum (Rs) of the red pixel, the grayscale data sum (Gs) of the green pixel, and the grayscale data sum (Bs) of the blue pixel to calculate the image parameter $Fn=\alpha'\times Rs+\beta'\times Gs+\gamma'\times Bs$. Here, Fn as the image parameter of the n-th frame image means the image parameter that is calculated in the current frame.

The parameter deviation of the image parameter Fn calculated in the current frame and the image parameter Fn−1 calculated in the previous frame is calculated as $\Delta F=(Fn-Fn-1)$ S140.

It is determined whether that parameter deviation ($\Delta F$) is larger than the second threshold value S150. The second threshold value is a predetermined value to determine the increasing/decreasing of the light emitting period of the current frame according to the difference between the average grayscale of the current frame image and the average grayscale of the previous frame image.

When the parameter deviation ($\Delta F$) is not larger than the second threshold value, the driving control signals CONT1" to CONT6" for the long period light emitting are generated S160. In other words, when the parameter deviation ($\Delta F$) is equal to or less than the second threshold value, the driving control signals CONT1" to CONT6" for the long period light emitting are generated. That the parameter deviation ($\Delta F$) is not larger than the second threshold value means that the difference of the average grayscales of the image of the previous frame and the image of the current frame is not large. When the difference of the average grayscales of the image of the previous frame and the image of the current frame is not large, although the first reset period (a1') resetting the gate voltage of the driving transistor is short, the gate voltage of the driving transistor may be sufficiently reset, and the light emitting period (d') is increased by the period that the first reset period (a1') is reduced, thereby increasing the luminance of the image of the current frame.

When the parameter deviation ($\Delta F$) is larger than the second threshold value, the driving control signals CONT1' to CONT6' for the short period light emitting are generated S170. That the parameter deviation ($\Delta F$) is larger than the second threshold value means that the image of the previous frame is an image that is relatively dark and the image of the current frame is an image that is relatively bright such that the difference of the average grayscale is large. In this case, the first reset period a1 is maintained to be long to sufficiently reset of the gate voltage of the driving transistor. Accordingly, the driving control signals CONT1' to CONT6' for the short period light emitting are generated, and thereby the image for the current frame is displayed during the light emitting period (d) of the short cycle.

Figure 10:
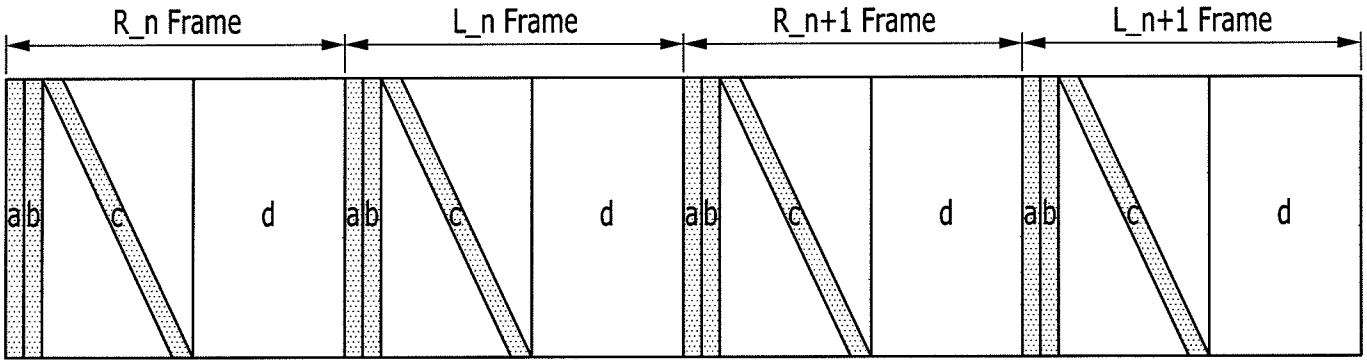
FIG. 10 is a view of a driving operation of a 3D simultaneous light emitting method of a display device according to an example embodiment.

FIG. 10 is a view of a driving operation of a 3D simultaneous light emitting method of a display device according to an example embodiment.

In the example embodiment shown in FIG. 10, the display device 10 may be operated with a 3D simultaneous light emitting method in which a left-eye image and a right-eye image are alternately displayed. As shown in FIG. 10, in the 3D simultaneous light emitting method, each frame includes a reset period (a), a compensation period (b), a scan period (c) and light emitting period (d).

A frame of which a plurality of data signals (hereinafter referred to as left-eye image data signals) representing a left-eye image are programmed to a plurality of pixels is denoted using referential numeral "L", and a frame of which a plurality of data signals (hereinafter referred to as right-eye image data signals) representing a right-eye image are programmed to the respective pixels is denoted using referential numeral "R".

In the reset period (a), the compensation period (b), the scan period (c), and the light emitting period (d), the waveform of the first power source voltage ELVDD, the second power source voltage ELVSS, the scan signals S[1]-S[n], the compensation control signal GC, the sustain voltage enable signal SUS_ENB, the first sustain voltage Vsusg, and the data signal data[j] is the same as the waveform shown in FIG. 5 or 6, and thus details of each period will not be repeated.

The right eye image data signal is written to a plurality of pixels in the scan period (c) of the R_n frame such that a plurality of pixels emit the light according to the right eye image data signal during the light emitting period (d) of the R_n frame.

The left eye image data signal is written to a plurality of pixels in the scan period (c) of the L_n frame such that a plurality of pixels emit the light according to the left eye image data signal during the light emitting period (d) of the L_n frame. At this time, a length of the light emitting period (d) of the L_n frame may be determined according to the image parameter F and the control parameter Count that are calculated in the L_n frame and the control parameter Count that is stored in the R_n frame as the previous frame of the L_n frame. Also, the length of the light emitting period (d) of the L_n frame may be determined according to the image parameter calculated in the L_n frame and the parameter deviation ΔF of the image parameter calculated in the R_n frame.

The right eye image data signal is written to a plurality of pixels in the scan period (c) of the R_n+1 frame, and a plurality of pixels emit the light according to the right eye image data signal during the light emitting period (d) of the R_n+1 frame. At this time, the length of the light emitting period (d) of the R_n+1 frame may be determined according to the image parameter F and the control parameter Count that are calculated in the R_n+1 frame and the control parameter Count stored in the L_n frame as the previous frame of the R_n+1 frame. Also, the length of the light emitting period (d) of the R_n+1 frame may be determined according to the image parameter calculated in the R_n+1 frame and the parameter deviation ΔF of the image parameter calculated in the Ln frame.

The left eye image data signal is written to a plurality of pixels in the scan period (c) of the Ln+1 frame, and a plurality of pixels emit the light according to the left eye image data signal during the light emitting period (d) of the Ln+1 frame. At this time, the length of the light emitting period (d) of the L_n+1 frame may be determined according of the image parameter F and the control parameter Count that are calculated in the L_n+1 frame and the control parameter Count stored in the R_n+1 frame as the previous frame of the L_n+1 frame. Also, the length of the light emitting period (d) of the L_n+1 frame may be determined according to the image parameter calculated in the L_n+1 frame and the parameter deviation ΔF of the image parameter calculated in the R_n+1 frame.

Meanwhile, when the display device 10 is capable of being operated in the 3D simultaneous light emitting method, the image signal ImS input to the display device 10 may include a 3D index instructing whether the 3D image exists. For example, the case in which the 3D index is 1 (3D index=1) instructs that the image signal ImS is the 3D image including the left-eye image and the right-eye image, and the case in which the 3D index is 0 (3D index=0) instructs that the image signal ImS is the signal of a general 2D image.

Next, a driving method of a signal controller 100 in a case that a display device 10 is a display device that is capable of being operated with the 3D simultaneous light emitting method will be described.

Figure 11:
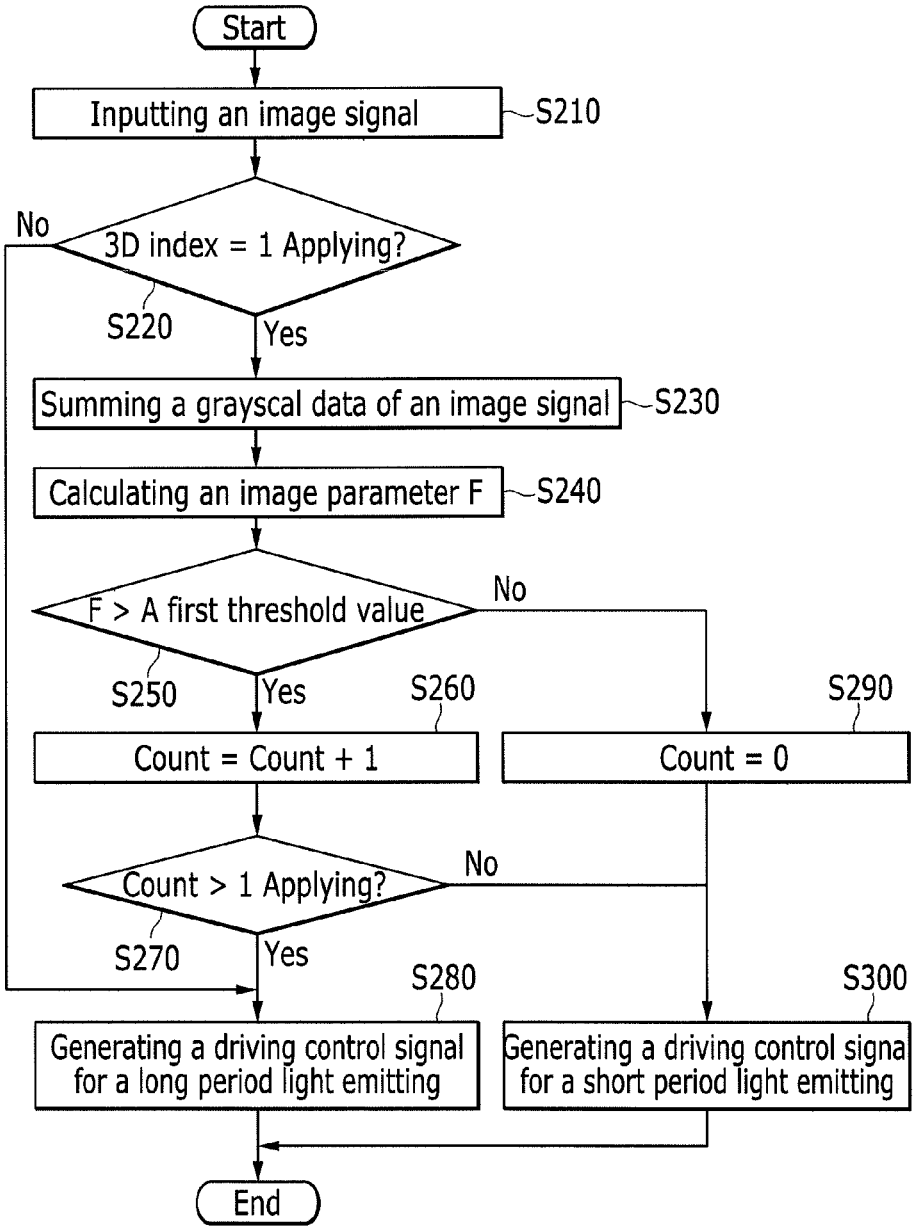
FIG. 11 is a flowchart of a driving method of a signal controller according to another example embodiment.

FIG. 11 is a flowchart of a driving method of a signal controller according to another example embodiment.

In the example embodiment shown in FIG. 11, the image signal ImS is input from the external device S210.

It is determined whether the 3D index included in the image signal ImS is 1 S220.

When the 3D index is not 1 (3D index=0), that is, when the image signal ImS input from the external device is the general 2D image, the driving control signals CONT1" to CONT6" for the long period light emitting are generated S280.

When the 3D index is 1 (3D index=1), that is, when the image signal ImS input from the external device is the 3D image, the grayscale data of the image signal ImS is added by the frame unit S230. That is, the grayscale data sum (Rs) of the red pixel, the grayscale data sum (Gs) of the green pixel, and the grayscale data sum (Bs) of the blue pixel are calculated by the frame unit. One frame of the frame unit means one frame of the left-eye image or one frame of the right-eye image.

The current contribution rate is multiplied by the grayscale data sum that is summed by the frame unit to calculate the image parameter F S240. The current contribution rate includes the current contribution rate α' of the red pixel, the current contribution rate β' of the green pixel, and the current contribution rate γ' of the blue pixel. The corresponding current contribution rate is respectively multiplied by the grayscale data sum (Rs) of the red pixel, the grayscale data sum (Gs) of the green pixel, and the grayscale data sum (Bs) of the blue pixel to calculate the image parameter $F=\alpha'\times Rs+\beta'\times Gs+\gamma'\times Bs$.

It is determined whether the image parameter F is larger than the first threshold value S250.

When the image parameter F is larger than the first threshold value, 1 is added and then the control parameter Count is stored S260.

When the image parameter F is not larger than the first threshold value, the control parameter Count is stored as 0 S290. In other words, when the image parameter F is equal to or less than the first threshold value, the control parameter Count is stored as 0.

After 1 is added to the control parameter Count, it is determined whether the control parameter Count is larger than 1 S270. The case in which the control parameter Count is 1 is a case in which the image parameter of the previous frame is smaller than the first threshold value such that the control parameter Count is stored as 0. That is, it means that the image of the previous frame is an image that is relatively dark. The case in which the control parameter Count is larger than 1, that is, the case in which the control parameter Count is at least 2, means that the image of the previous frame is an image that is relatively bright.

When the control parameter Count is larger than 1, the driving control signals CONT1" to CONT6" for the long period light emitting are generated S280. That is, when the image of the previous frame and the image of the current frame are each an image that is relatively bright, the driving control signals CONT1" to CONT6" for the long period light emitting are generated, and accordingly the image of the current frame is displayed during the light emitting period (d') of the long cycle. In the case that the image of the previous frame is an image that is relatively bright, although the first reset period (a1') resetting the gate voltage of the driving transistor is short, the gate voltage of the driving transistor may be sufficiently reset, and the light emitting period (d') is increased as the first reset period (a1') is short such that the luminance of the image of the current frame may be increased.

When the image parameter F is not larger than the first threshold value such that the control parameter Count is stored as 0 or the control parameter Count is equal to or less than 1, the driving control signals CONT1' to CONT6' for the short period light emitting are generated S300. That is, when the image of the current frame is an image that is relatively dark, the driving control signals CONT1' to CONT6' for the short period light emitting are generated, and accordingly the image of the current frame is displayed during the light emitting period (d) of the short cycle. When the image of the current frame is an image that is relatively dark, the light emitting period is increased such that it is not necessary to increase the luminance of the image.

Although the image of the current frame is an image that is relatively bright, in the case that the image of the previous frame is an image that is relatively dark, the driving control signals CONT1' to CONT6' of the short period light emitting are generated, and accordingly the image of the current frame is displayed during the light emitting period (d) of the short cycle. Thus, the first reset period a1 is maintained to be long to reset the gate voltage of the driving transistor in the case that the image of the previous frame is an image that is relatively dark.

As described above, when the image signal ImS is the 2D image, the driving control signals CONT1" to CONT6" for the long period light emitting may be generated. In the case that the image signal ImS is the 3D image, one of the driving control signals CONT1' to CONT6' for the short period light emitting and the driving control signals CONT1" to CONT6" for the long period light emitting may be generated by considering the image parameter F calculated in the current frame, the control parameter Count, and the control parameter Count stored in the previous frame.

Figure 12:
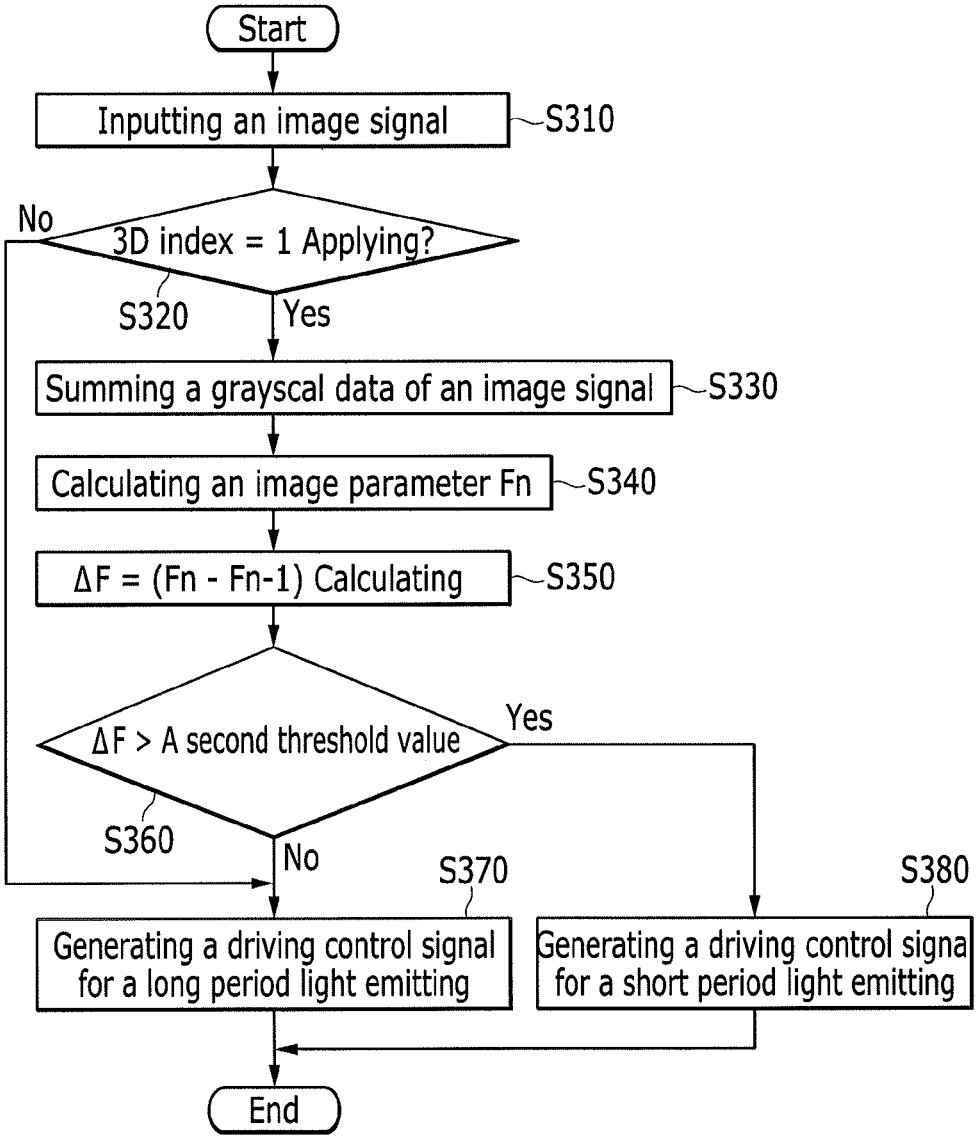
FIG. 12 is a flowchart of a driving method of a signal controller according to an example embodiment.

FIG. 12 is a flowchart of a driving method of a signal controller according to another example embodiment.

In the example embodiment shown in FIG. 12, the image signal ImS is input from the external device S310.

It is determined whether the 3D index included in the image signal ImS is 1 S320.

When the 3D index is not 1 (3D index=0), that is, the image signal ImS from the outside is the general 2D image, the driving control signals CONT1" to CONT6" for the long period light emitting are generated S370.

When the 3D index is 1 (3D index=1), that is, the image signal ImS from the outside is the 3D image, the grayscale data of the image signal ImS is summed by the frame unit S330. That is, the grayscale data sum (Rs) of the red pixel, the grayscale data sum (Gs) of the green pixel, and the grayscale data sum (Bs) of the blue pixel are calculated by the frame unit.

The current contribution rate is multiplied by the grayscale data sum that is added by the frame unit to calculate the image parameter Fn S340. The current contribution rate includes the current contribution rate $\alpha'$ of the red pixel, the current contribution rate $\beta'$ of the green pixel, and the current contribution rate $\gamma'$ of the blue pixel. The corresponding current contribution rate is respectively multiplied by the grayscale data sum (Rs) of the red pixel, the grayscale data sum (Gs) of the green pixel, and the grayscale data sum (Bs) of the blue pixel to calculate the image parameter $F=\alpha'\times Rs+\beta'\times Gs+\gamma'\times Bs$.

Here, Fn as the image parameter of the n-th frame image means the image parameter calculated in the current frame. The n-th frame may be the left-eye image frame (or the right-eye image frame), and the n−1−the frame as the previous frame of the n-th frame may be the right-eye image frame (or the left-eye image frame).

The parameter deviation $\Delta F=(Fn-Fn-1)$ of the image parameter Fn calculated in the current frame and the image parameter Fn−1 calculated in the previous frame is calculated S350.

It is determined whether the parameter deviation ($\Delta F$) is larger than the second threshold value S360. The second threshold value is a predetermined value to determine the increasing/decreasing of the light emitting period of the current frame according to the difference between the average grayscale of the current frame image and the average grayscale of the previous frame image.

When the parameter deviation ($\Delta F$) is not larger than the second threshold value, the driving control signals CONT1" to CONT6" for the long period light emitting are generated S370. In other words, when the parameter deviation ($\Delta F$) is equal to or less than the second threshold value, the driving control signals CONT1" to CONT6" for the long period light emitting are generated. That the parameter deviation ($\Delta F$) is not larger than the second threshold value means that the average grayscale difference between the image of the previous frame and the image of the current frame is not large. When the average grayscale difference between the image of the previous frame and the image of the current frame is not large, although the first reset period (a1') resetting the gate voltage of the driving transistor is short, the gate voltage of the driving transistor may be sufficiently reset, and the luminance of the image of the current frame may be increased by increasing the light emitting period (d') as the first reset period (a1') is decreased.

When the parameter deviation ($\Delta F$) is larger than the second threshold value, the driving control signals CONT1' to CONT6' for the short period light emitting are generated S380. That the parameter deviation ($\Delta F$) is larger than the second threshold value means that the image of the previous frame is an image that is relatively dark and the image of the current frame is an image that is relatively bright such that the average grayscale difference is large. In this case, the first reset period a1 is maintained to be long to sufficiently reset the gate voltage of the driving transistor. Accordingly, the driving control signals CONT1' to CONT6' for the short period light emitting are generated, and accordingly the image of the current frame is displayed during the light emitting period (d) of the short cycle.

As described above, when the image signal ImS is the 2D image, the driving control signals CONT1" to CONT6" for the long period light emitting may be generated. When the image signal ImS is the 3D image, one of the driving control signals CONT1' to CONT6' for the short period light emitting and the driving control signals CONT1" to CONT6" for the long period light emitting may be generated according to the parameter deviation $\Delta F$ of the image parameter F calculated in the current frame and the image parameter Fn−1 calculated in the previous frame.

By way of summation and review, a pixel of an active matrix organic light emitting diode (OLED) display may include an organic light emitting diode, a driving transistor that controls a current amount that is supplied to the organic light emitting diode, and a switching transistor that transmits the data voltage that controls the light emitting amount of the organic light emitting diode to the driving transistor. In one frame, the driving transistor supplies a current corresponding to the data voltage applied to the gate electrode to the organic light emitting diode (OLED). In a next frame, the gate voltage of the driving transistor is reset to remove hysteresis.

If the gate voltage of the driving transistor of the previous frame is not sufficiently reset, the data voltage may be incorrectly reflected to the gate electrode of the driving transistor. As such, the organic light emitting diode (OLED) may not emit light with the desired brightness, and thus image quality of the display device may be deteriorated. For example, when displaying a white screen after displaying a black screen, a reset period for resetting a gate voltage of the driving transistor may be lengthened. If the reset period is not properly set, a luminance deterioration of the white screen may occur. Generally, the reset period is determined as a fixed time in one frame, based on the case that the white screen is displayed after displaying the black screen. For example, in the organic light emitting diode (OLED) display in which one frame is 8.33 ms, the reset period is allocated as 872 μs that is about 10% of one frame. Resultantly, the light emitting period is decreased by the reset period in one frame, and the decrease of the light emitting period negatively influences the luminance of the display device.

As described above, embodiments relate to a display device adaptively controlling a light emitting period, a signal control device of the display device, and a driving method thereof. The light emitting period may be adaptively controlled according to the image signal of the display device, and the light emitting period may be increased such that the luminance of the display device may be improved.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

DESCRIPTION OF SYMBOLS

10: display device
20: pixel
100: signal controller
110: image signal adder
120: image parameter calculator
130: image parameter comparator
140: driving control signal generator
200: scan driver
300: data driver
400: power supply unit
500: compensation control signal unit
600: storage power supply unit
700: MUX unit
**700*j***: unit MUX
800: display unit

What is claimed is:

1. A display device, comprising:

a plurality of pixels;

a scan driver to sequentially apply a scan signal to a plurality of scan lines coupled to the plurality of pixels;

a data driver to apply a data signal corresponding to the scan signal to a plurality of data lines coupled to the plurality of pixels;

a signal controller to calculate an image parameter from an image signal, and to generate and transmit one of a driving control signal for short period light emitting or a driving control signal for long period light emitting to the scan driver and the data driver by using the image parameter;

a sustain power supply to receive a driving control signal for a sustain voltage and determine levels of a sustain voltage according to a driving control signal for the sustain voltage, and to supply the sustain voltage to the plurality of data lines; and a MUX unit connecting the data driver or the sustain power supply to the plurality of data lines according to the driving control signal for short period light emitting or the driving control signal for long period light emitting, wherein:

the driving control signal for short period light emitting is a signal controlling a light emitting period in which the plurality of pixels emit light during one frame with a first period, the driving control signal for long period light emitting is a signal controlling the light emitting period with a second period in another frame that is longer than the first period, the second period being longer than the first period by a period Δd, a frame length of the first frame and a frame length of the second frame being equal, and the driving control signal selectively controlling application of a sustain voltage to a gate of a driving transistor during the period Δd, and an ELVSS voltage applied to the pixels is a high level during the period Δd of the first frame and a low level during the period Δd of the second frame.

2. The display device as claimed in claim 1, wherein:

a second reset period, in which a gate voltage of the driving transistor is reset by application of the sustain voltage during a second frame according to the driving control signal for long period light emitting, is shorter than a first reset period, in which the gate voltage of the driving transistor is reset by application of the sustain voltage during a first frame according to the driving control signal for short period light emitting, by the period Δd.

3. The display device as claimed in claim 2, wherein a time of a second compensation period compensating a threshold voltage of the driving transistor during a second frame according to the driving control signal for long period light emitting is earlier than a time of a first compensation period compensating the threshold voltage of the driving transistor during the first frame according to the driving control signal for short period light emitting by the period Δd.

4. The display device as claimed in claim 3, wherein a time of a second scan period in which the data signal is written to a plurality of pixels during the second frame according to the driving control signal for long period light emitting is earlier than a time of a first scan period in which the data signal is written to a plurality of pixels during the first frame according to the driving control signal for short period light emitting by the period Δd.

5. The display device as claimed in claim 1, wherein:

the signal controller sums grayscale data of the image signal by a frame unit to calculate a grayscale data sum, and a current contribution rate is multiplied by the grayscale data sum to calculate the image parameter.

6. The display device as claimed in claim 5, wherein:

the grayscale data of the image signal includes grayscale data of a red pixel, grayscale data of a green pixel, and grayscale data of a blue pixel, and the signal controller sums the grayscale data of the red pixel, the grayscale data of the green pixel, and the grayscale data of the blue pixel by a frame unit to calculate a grayscale data sum of the red pixel, a grayscale data sum of the green pixel, and a grayscale data sum of the blue pixel.

7. The display device as claimed in claim 6, wherein the signal controller sums a first value for which a current contribution rate of the red pixel is multiplied by the grayscale data sum of the red pixel, a second value for which a current contribution rate of the green pixel is multiplied by the grayscale data sum of the green pixel, and a third value for which a current contribution rate of the blue pixel is multiplied by the grayscale data sum of the blue pixel to calculate the image parameter.

8. The display device as claimed in claim 1, wherein the signal controller compares the image parameter with a first threshold value, and if the image parameter is larger than the first threshold value, the signal controller generates the driving control signal for long period light emitting, while if the image parameter is equal to or less than the first threshold value, the signal controller generates the driving control signal for short period light emitting.

9. The display device as claimed in claim 8, wherein:

the signal controller stores a control parameter by adding 1 if the image parameter is larger than the first threshold value, and if the image parameter is equal to or less than the first threshold value, the control parameter is stored as 0.

10. The display device as claimed in claim 9, wherein, after the signal controller stores the control parameter by adding 1, when the stored control parameter is larger than 1, the signal controller generates the driving control signal for long period light emitting, and when the stored control parameter is 1, the signal controller generates the driving control signal for short period light emitting.

11. The display device as claimed in claim 9, wherein the signal controller generates the driving control signal for short period light emitting when the control parameter is 0.

12. The display device as claimed in claim 1, wherein the signal controller calculates a parameter deviation of a first image parameter calculated in a current frame and a second image parameter calculated in a previous frame.

13. The display device as claimed in claim 12, wherein the signal controller compares the parameter deviation with a second threshold value, and if the parameter deviation is larger than the second threshold value, the signal controller generates the driving control signal for short period light emitting, while if the parameter deviation is equal to or less than the second threshold value, the signal controller generates the driving control signal for long period light emitting.

14. The display device as claimed in claim 1, wherein the signal controller calculates the image parameter when a 3D index included in the image signal instructs a 3D image.

15. The display device as claimed in claim 14, wherein when the 3D index instructs a 2D image, the signal controller generates the driving control signal for long period light emitting.

16. The display device as claimed in claim 1, wherein the plurality of pixels simultaneously emit the light during the first period and the second period.

17. A signal control device, comprising:

an image signal adder to add grayscale data by an image signal by a frame unit to calculate a grayscale data sum;

an image parameter calculator to multiply a current contribution rate by the grayscale data sum to calculate an image parameter;

an image parameter comparator to compare the image parameter with a threshold value; and a driving control signal generator to generate one of a driving control signal for short period light emitting or a driving control signal for long period light emitting according to a comparison result of the image parameter and the threshold value, wherein:

the driving control signal for short period light emitting or the driving control signal for long period light emitting are transmitted to a MUX unit connecting a data driver or a sustain power supply unit to a plurality of data lines coupled to a plurality of pixels, the data driver applying a data signal to the plurality of data lines, the sustain power supply to receive a driving control signal for a sustain voltage and determine levels of a sustain voltage according to a driving control signal for the sustain voltage, and to supply the sustain voltage to the plurality of data lines, the driving control signal for short period light emitting is a signal controlling a light emitting period in which the plurality of pixels emit light during one frame with a first period, the driving control signal for long period light emitting is a signal controlling the light emitting period with a second period that is longer than the first period in a second frame, the second period being longer than the first period by a period $\Delta d$, a frame length of the first frame and a frame length of the second frame being equal, and the driving control signal selectively controlling application of the sustain voltage to a gate of a driving transistor during the period $\Delta d$, and an ELVSS voltage applied to the pixels is a high level during the period $\Delta d$ of the first frame and a low level during the period $\Delta d$ of the second frame.

18. The signal control device as claimed in claim 17, wherein:

the grayscale data of the image signal includes grayscale data of a red pixel, grayscale data of a green pixel, and grayscale data of a blue pixel, and the image signal adder sums the grayscale data of the red pixel, the grayscale data of the green pixel, and the grayscale data of the blue pixel by a frame unit to calculate a grayscale data sum of the red pixel, a grayscale data sum of the green pixel, and a grayscale data sum of the blue pixel.

19. The signal control device as claimed in claim 18, wherein the image parameter calculator sums a first value for which a current contribution rate of the red pixel is multiplied by the grayscale data sum of the red pixel, a second value for which a current contribution rate of the green pixel is multiplied by the grayscale data sum of the green pixel, and a third value for which a current contribution rate of the blue pixel is multiplied by the grayscale data sum of the blue pixel to calculate the image parameter.

20. The signal control device as claimed in claim 17, wherein the image parameter comparator compares the image parameter with the first threshold value, and if the image parameter is larger than the first threshold value, a first signal generating the driving control signal for long period light emitting is transmitted to the driving control signal generator, while if the image parameter is equal to or less than the first threshold value, a second signal generating the driving control signal for short period light emitting is transmitted to the driving control signal generator.

21. The signal control device as claimed in claim 20, wherein the image parameter comparator stores a control parameter by adding 1 if the image parameter is larger than the first threshold value, and if the image parameter is equal to or less than the first threshold value, the control parameter is stored as 0.

22. The signal control device as claimed in claim 21, wherein after the image parameter comparator stores the control parameter by adding 1, the image parameter comparator generates a first signal when the stored control parameter is larger than 1, and the image parameter comparator generates a second signal when the stored control parameter is 1.

23. The signal control device as claimed in claim 21, wherein the image parameter comparator generates the second signal when the control parameter is 0.

24. The signal control device as claimed in claim 17, wherein the image parameter calculator calculates a parameter deviation of a first image parameter calculated in a current frame and a second image parameter calculated in a previous frame.

25. The signal control device as claimed in claim 24, wherein the image parameter comparator compares the parameter deviation with a second threshold value, and if the parameter deviation is larger than the second threshold value, the image parameter comparator transmits a second signal generating the driving control signal for short period light emitting to the driving control signal generator, while if the parameter deviation is equal to or less than the second threshold value, the image parameter comparator transmits a first signal generating the driving control signal for long period light emitting to the driving control signal generator.

26. The signal control device as claimed in claim 17, wherein when a 3D index included in the image signal instructs a 3D image, the driving control signal generator generates one of the driving control signal for short period light emitting or the driving control signal for long period light emitting according to a comparison result of the image parameter and the threshold value.

27. The signal control device as claimed in claim 26, wherein when the 3D index instructs a 2D image, the driving control signal generator generates the driving control signal for long period light emitting.

28. A signal control method, comprising:

summing grayscale data of an image signal by a frame unit to calculate a grayscale data sum;

multiplying a current contribution rate by the grayscale data sum to calculate an image parameter;

comparing the image parameter with a threshold value; and generating one of a driving control signal for short period light emitting or a driving control signal for long period light emitting according to a comparison result of the image parameter and the threshold value;

transmitting the driving control signal for short period light emitting or the driving control signal for long period light emitting to a MUX unit connecting a data driver or a sustain power supply unit to a plurality of data lines coupled to a plurality of pixels, wherein:

the data driver applies a data signal to the plurality of data lines, the sustain power supply unit determines levels of a sustain voltage according to a driving control signal for the sustain voltage, and supplies the sustain voltage to the plurality of data lines, the driving control signal for short period light emitting is a signal controlling a light emitting period in which or plurality of pixels emit light during one frame with a first period, the driving control signal for long period light emitting is a signal controlling the light emitting period with a second period that is longer than the first period in a second frame, the second period being longer than the first period by a period Δd, a frame length of the first frame and a frame length of the second frame being the same, and the driving control signal selectively controlling application of or sustain voltage to a gate of a driving transistor during the period Δd, and an ELVSS voltage applying to the pixels is high level during the period Δd of the first frame and low level during the period Δd of the second frame.

29. The method as claimed in claim 28, wherein the calculation of the grayscale data sum includes summing grayscale data of a red pixel, grayscale data of a green pixel, and grayscale data of a blue pixel by a frame unit to calculate a grayscale data sum of the red pixel, a grayscale data sum of the green pixel, and a grayscale data sum of the blue pixel.

30. The method as claimed in claim 29, wherein the calculation of the image parameter includes summing a first value for which a current contribution rate of the red pixel is multiplied by the grayscale data sum of the red pixel, a second value for which a current contribution rate of the green pixel is multiplied by the grayscale data sum of the green pixel, and a third value for which a current contribution rate of the blue pixel is multiplied by the grayscale data sum of the blue pixel to calculate the image parameter.

31. The method as claimed in claim 28, wherein the comparison of the image parameter with the threshold value includes:

comparing the image parameter with a first threshold value;

generating a first signal generating the driving control signal for long period light emitting if the image parameter is larger than the first threshold value; and generating a second signal generating the driving control signal for short period light emitting if the image parameter is equal to or less than the first threshold value.

32. The method as claimed in claim 31, wherein the comparison of the image parameter with the threshold value further includes:

storing a control parameter by adding 1 if the image parameter is larger than the first threshold value; and storing the control parameter as 0 if the image parameter is equal to or less than the first threshold value.

33. The method as claimed in claim 32, wherein the comparison of the image parameter with the threshold value further includes:

generating the first signal when the stored control parameter is larger than 1; and generating the second signal when the stored control parameter is 1.

34. The method as claimed in claim 32, wherein the comparison of the image parameter with the threshold value further includes generating the second signal when the stored control parameter is 1.

35. The method as claimed in claim 28, wherein the calculation of the image parameter includes calculating a parameter deviation of a first image parameter calculated in a current frame and a second image parameter calculated in a previous frame.

36. The method as claimed in claim 35, wherein the comparison of the image parameter with the threshold value includes:

comparing the parameter deviation with a second threshold value;

generating a second signal generating the driving control signal for short period light emitting if the image parameter is larger than the second threshold value; and generating a first signal generating the driving control signal for long period light emitting if the parameter deviation is equal to or less than the second threshold value.

37. The method as claimed in claim 28, wherein the generation of one of the driving control signal for short period light emitting or the driving control signal for long period light emitting includes generating one of the driving control signal for short period light emitting and the driving control signal for long period light emitting according to a comparison result of the image parameter and the threshold value when a 3D index included in the image signal instructs a 3D image.

38. The method as claimed in claim 37, wherein the generation of one of the driving control signal for short period light emitting or the driving control signal for long period light emitting includes generating the driving control signal for long period light emitting when the 3D index instructs a 2D image.

* * * * *